US012055299B2

(12) United States Patent
Fujita et al.

(10) Patent No.: US 12,055,299 B2
(45) Date of Patent: Aug. 6, 2024

(54) COMBUSTOR AND GAS TURBINE

(71) Applicant: MITSUBISHI HEAVY INDUSTRIES ENGINE & TURBOCHARGER, LTD., Sagamihara (JP)

(72) Inventors: Shinji Fujita, Tokyo (JP); Hikaru Kurosaki, Tokyo (JP); Yuta Ishii, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 48 days.

(21) Appl. No.: 17/796,491

(22) PCT Filed: Feb. 19, 2020

(86) PCT No.: PCT/JP2020/006389
§ 371 (c)(1),
(2) Date: Jul. 29, 2022

(87) PCT Pub. No.: WO2021/166092
PCT Pub. Date: Aug. 26, 2021

(65) Prior Publication Data
US 2023/0349556 A1 Nov. 2, 2023

(51) Int. Cl.
*F23R 3/60* (2006.01)

(52) U.S. Cl.
CPC ..... *F23R 3/60* (2013.01); *F23R 2900/03042* (2013.01)

(58) Field of Classification Search
CPC .... F23R 3/60; F23R 3/42; F23R 2900/03042; F02C 7/18
See application file for complete search history.

(56) References Cited

U.S. PATENT DOCUMENTS 3,940,253 A 2/1976 Zetterström
4,292,810 A * 10/1981 Glenn ..... F23R 3/08 60/757

(Continued)

FOREIGN PATENT DOCUMENTS

JP 54-171002 U 5/1978
JP 6-201129 A 7/1994

(Continued)

OTHER PUBLICATIONS

International Preliminary Report on Patentability and Written Opinion of the International Searching Authority for International Application No. PCT/JP2020/006389, dated Sep. 1, 2022, with an English translation.

(Continued)

*Primary Examiner* — Craig Kim
(74) *Attorney, Agent, or Firm* — Birch, Stewart, Kolasch & Birch, LLP

(57) ABSTRACT

A combustor includes: a combustion cylinder; and a combustion-chamber forming member disposed so as to be at least partially inserted into the combustion cylinder and forming a combustion chamber with the combustion cylinder. A radial-direction gap for introducing film air is formed between the combustion cylinder and the combustion-chamber forming member. A gas turbine includes a combustor; a compressor for generating compressed air; and a turbine configured to be rotary driven by combustion gas from the combustor.

21 Claims, 19 Drawing Sheets

(56) References Cited

U.S. PATENT DOCUMENTS

| | | | | |
|---|---|---|---|---|
| 4,944,151 | A | 7/1990 | Hovnanian | |
| 5,201,799 | A * | 4/1993 | Johnson | F16B 21/18 24/563 |
| 6,435,820 | B1 * | 8/2002 | Overberg | F01D 25/246 415/173.1 |
| 11,767,792 | B1 * | 9/2023 | Lefebvre | F01D 9/026 415/229 |
| 2012/0180500 | A1 | 7/2012 | Dicintio | |
| 2013/0111923 | A1 * | 5/2013 | Donnelly | F02C 7/143 60/792 |
| 2014/0216046 | A1 | 8/2014 | Armstrong et al. | |
| 2014/0345249 | A1 | 11/2014 | Fukuda et al. | |
| 2015/0300648 | A1 | 10/2015 | Saito et al. | |
| 2016/0003477 | A1 * | 1/2016 | Propheter-Hinckley | F23R 3/005 60/752 |
| 2016/0003481 | A1 * | 1/2016 | Taniguchi | F01D 9/023 60/737 |
| 2016/0033129 | A1 * | 2/2016 | Burd | F23R 3/002 29/889.22 |
| 2016/0273776 | A1 * | 9/2016 | Takiguchi | F23R 3/343 |
| 2017/0108221 | A1 * | 4/2017 | Mizukami | F01D 9/023 |
| 2017/0159565 | A1 * | 6/2017 | Evulet | F02K 1/36 |
| 2017/0284672 | A1 * | 10/2017 | Tsunoda | F23R 3/48 |
| 2020/0158341 | A1 * | 5/2020 | Bloom | F23R 3/60 |
| 2021/0010422 | A1 * | 1/2021 | Kasuya | F02C 7/12 |
| 2021/0172603 | A1 * | 6/2021 | Tsuei | F23R 3/58 |
| 2022/0127967 | A1 * | 4/2022 | Radwanski | F01D 9/023 |
| 2023/0103612 | A1 * | 4/2023 | DeShong | B33Y 80/00 60/752 |

FOREIGN PATENT DOCUMENTS

| | | | | |
|---|---|---|---|---|
| JP | 8-7248 | Y2 | 3/1996 | |
| JP | 9-280564 | A | 10/1997 | |
| JP | 8-312961 | A | 11/1998 | |
| JP | 2012-145325 | A | 8/2012 | |
| JP | 2014-92286 | A | 5/2014 | |
| JP | 2014-178076 | A | 9/2014 | |
| JP | 2014-227885 | A | 12/2014 | |
| JP | 2021004714 | A * | 1/2021 | F02C 7/10 |

OTHER PUBLICATIONS

International Search Report and Written Opinion of the International Searching Authority for International Application No. PCT/JP2020/006389, dated Apr. 21, 2020.

Japanese Office Action for Japanese Application No. 2022-501457, dated Oct. 3, 2023, with an English translation.

* cited by examiner

V – V

COMBUSTOR AND GAS TURBINE

TECHNICAL FIELD

The present disclosure relates to a combustor and a gas turbine.

BACKGROUND ART

Small gas turbines also known as micro gas turbines can be used for various usages such as private power generators in stores, hospitals, and the like, range extenders of electric vehicles, and transportable powers. Various configurations are known for a combustor used in a gas turbine. For instance, Patent Documents 1 to 3 disclose a combustor configured to elastically support a combustion cylinder (liner) using a spring member in order to improve strength and suppress vibration of parts.

CITATION LIST

Patent Literature

Patent Document 1: JPH8-7246U (Utility Model)
Patent Document 2: JPH9-280564A
Patent Document 3: JPH8-312961A

SUMMARY

Problems to be Solved

Meanwhile, to suppress NOx and CO, it is necessary to increase the temperature of the combustion region (e.g., the inside of the combustion chamber) of the combustor. However, the parts constituting the combustion region (e.g., the combustion cylinder) may not have an adequate heat resistance. Thus, it is desirable to cool the parts in the region where the temperature is likely to rise (e.g., where the combustion-chamber forming member is inserted into the combustion cylinder).

In this regard, none of the Patent Documents 1 to 3 discloses such a configuration. In addition, the combustors disclosed in Patent Documents 1 to 3 are all ceramic combustors. A ceramic material usually has a higher heat resistance than a metal material.

In view of the above, an object of the present disclosure is to provide a combustor and a gas turbine capable of ensuring the cooling performance in a region where the temperature is likely to rise.

Solution to the Problems

A combustor according to an embodiment of the present disclosure includes: a combustion cylinder; and a combustion-chamber forming member disposed so as to be at least partially inserted into the combustion cylinder and forming a combustion chamber with the combustion cylinder. A radial-direction gap for introducing film air is formed between the combustion cylinder and the combustion-chamber forming member.

A combustor according to an embodiment of the present disclosure includes: a combustion cylinder; a combustion-chamber forming member disposed so as to be at least partially inserted into the combustion cylinder and forming a combustion chamber with the combustion cylinder; a casing into which the combustion cylinder is inserted, the casing being configured so as to cover an outer periphery of the combustion cylinder; and a retention member for elastically retaining a tip end of the combustion cylinder on the casing. The casing includes an inward flange for retaining the tip end of the combustion cylinder. The inward flange has a chamfered surface at an upstream-side end portion at an inner side in the radial direction.

A gas turbine according to an embodiment of the present disclosure includes: the combustor according to any one of the above; a compressor for generating compressed air; and a turbine configured to be rotary driven by combustion gas from the combustor.

Advantageous Effects

According to the present disclosure, it is possible to provide a combustor and a gas turbine capable of ensuring the cooling performance in a region where the temperature is likely to increase.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

(Overall Configuration)

Figure 1:
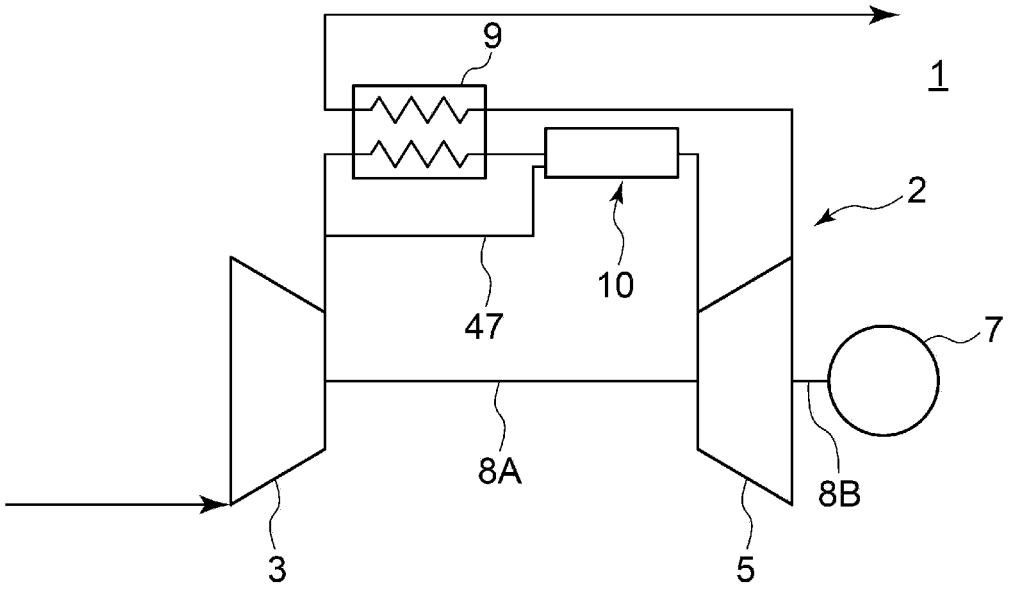
FIG. 1 is a diagram showing an overall configuration of a power generation apparatus including a gas turbine according to an embodiment.

FIG. 1 is a diagram showing an overall configuration of a power generation apparatus 1 including a gas turbine 2 according to an embodiment. As depicted in FIG. 1, power the generation apparatus 1 includes a gas turbine 2, a generator 7, and a heat exchanger 9.

The power generation apparatus 1 is used in, for instance, a range extender of an automobile or a transportable power source. The gas turbine 2 includes a compressor 3 for generating compressed air, a combustor 10 for generating combustion gas from the compressed air and fuel, and a turbine 5 configured to be rotary driven by combustion gas. The gas turbine 2 may be a micro gas turbine, or a gas turbine to be mounted to an automobile.

The compressor 3 is connected to the turbine 5 via a rotational shaft 8A. The compressor 3 is rotary driven by rotation energy of the turbine 5 to generate compressed air. The compressed air generated by the compressor 3 is supplied to the combustor 10 via a heat exchanger 9. According to some embodiments, a part of compressed air generated by the compressor 3 is supplied to the combustor 10 not via the heat exchanger 9, which will be described later in detail. The compressor 3 may be a centrifugal compressor, for instance.

The combustor 10 according to some embodiments is supplied with fuel and the compressed air generated by the compressor 3 and heated by the heat exchanger 9, and the combustor 10 combusts the fuel to generate combustion gas that serves as a working fluid of the turbine 5. The combustion gas is sent to the turbine 5 at a latter stage from the combustor 10.

The turbine 5 according to some embodiments includes, for instance, a radial turbine wheel or a mixed-flow turbine wheel, and is driven by combustion gas generated by the combustor 10. The turbine 5 is connected to the generator 7 via a rotational shaft 8B. That is, the generator 7 is configured to generate power using rotational energy of the turbine 5.

The combustion gas discharged from the turbine 5 is supplied to the heat exchanger 9. The heat exchanger 9 is configured to exchange heat between combustion gas discharged from the turbine 5 and compressed air supplied from the compressor 3. That is, at the heat exchanger 9, compressed air supplied from the compressor 3 is heated by combustion gas discharged from the turbine 5.

In some embodiments, the gas turbine 2 includes a cooling air pipe 47 for supplying cooling air for cooling an ignition plug 41 (see FIG. 4 described below) of the combustor 10. The cooling air pipe 47 is configured to be capable of supplying compressed air from the compressor 3 to the combustor 10 without passing through the heat exchanger 9. Alternatively, the cooling air pipe 47 may be configured to be capable of supplying compressed air after passing through and being heated by the heat exchanger 9 to the combustor 10.

Figure 2:
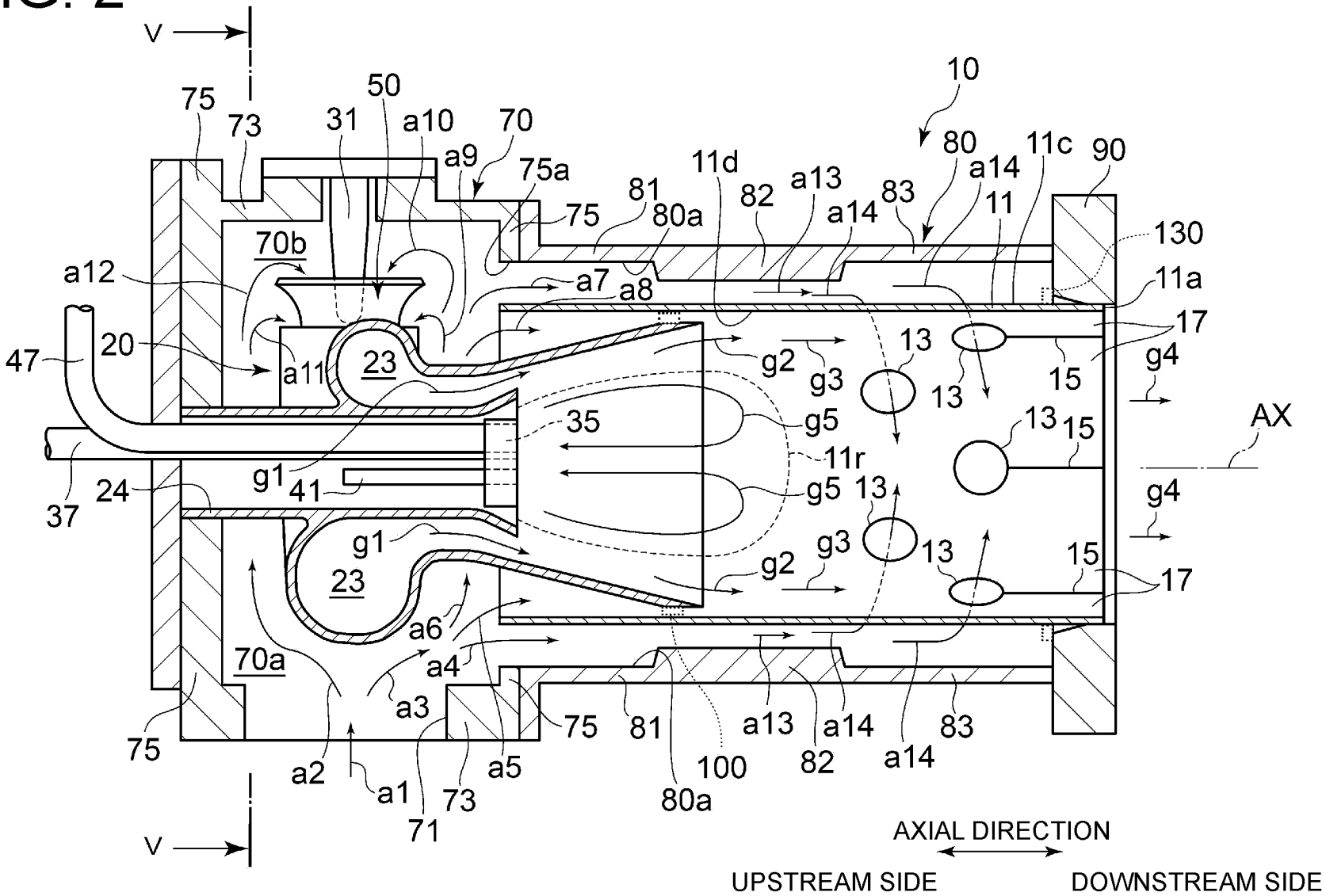
FIG. 2 is a schematic diagram showing a cross section taken along the axis AX of a combustion cylinder of a combustor according to an embodiment.

Compressed air (cooling air) from the compressor 3 flowing through the cooling air pipe 47 cools the ignition plug 41 in the process of flowing out into the combustion cylinder 11, as depicted in FIG. 2 described below. Accordingly, it is possible to suppress negative effects of heat of the flame inside the combustion cylinder 11 on the ignition plug 41.

(Combustor 10)

Figure 3:
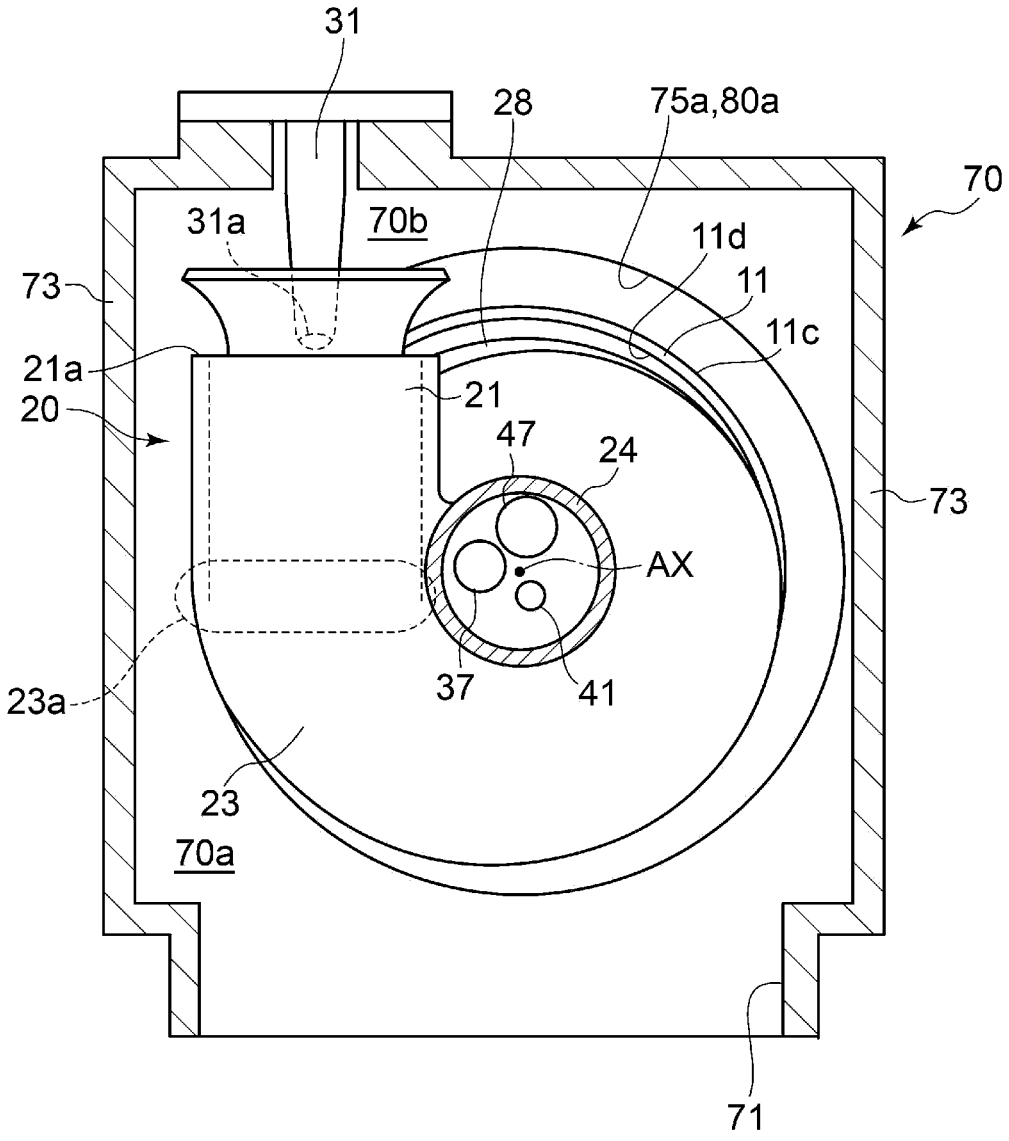
FIG. 3 is a schematic diagram showing a cross-sectional arrow view taken along line V-V in FIG. 2.
Figure 4:
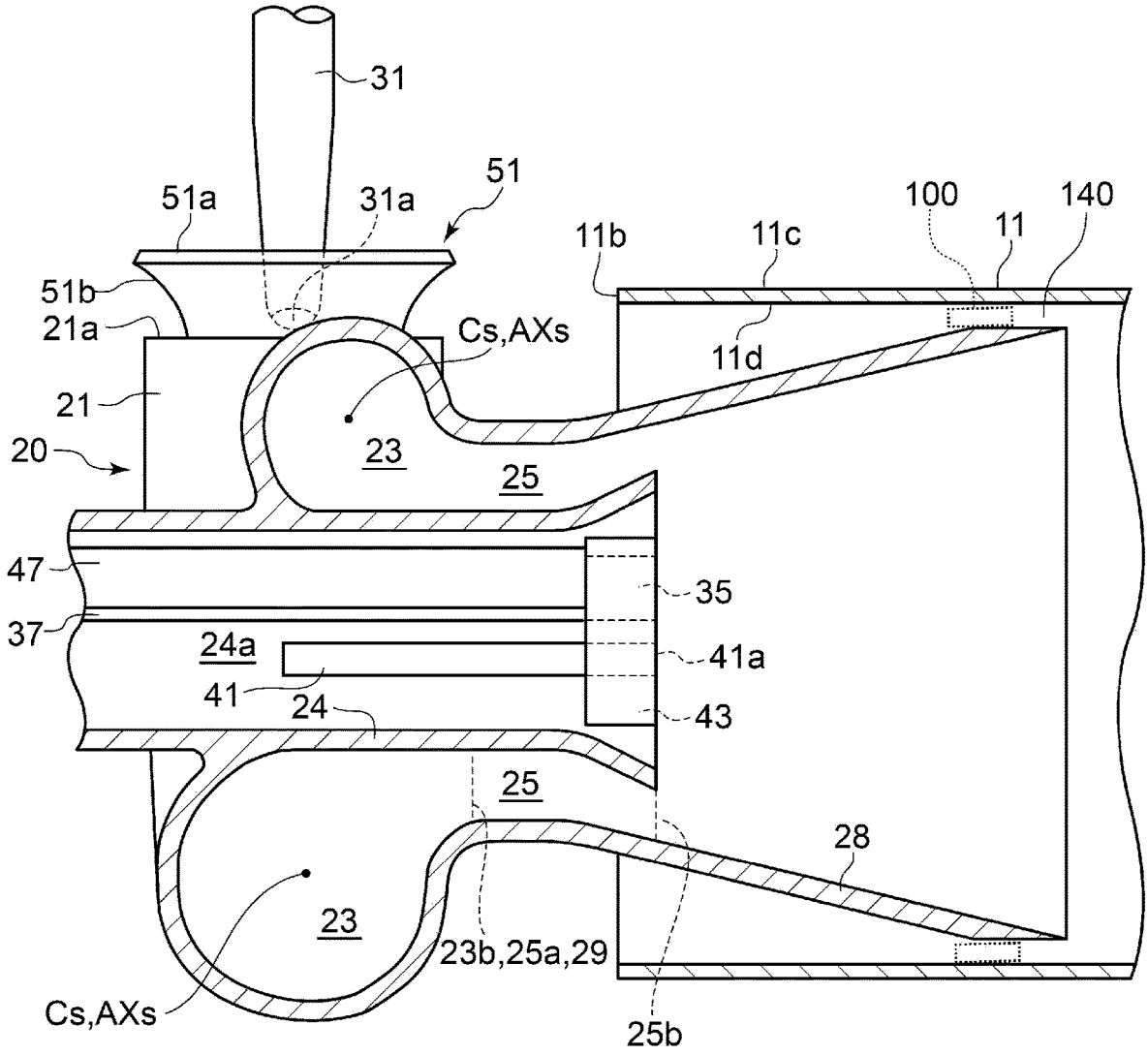
FIG. 4 is an enlarged schematic view showing the vicinity of the premixing tube in FIG. 2.

FIG. 2 is a schematic view showing a cross section taken along the axis AX of the combustion cylinder 11 of the combustor 10 according to an embodiment. FIG. 3 is a schematic view showing a cross-sectional arrow view taken along line V-V in FIG. 2. FIG. 4 is an enlarged schematic view showing the vicinity of the premixing tube 20 in FIG. 2.

The combustor 10 according to some embodiments includes, as depicted in FIGS. 2 to 4 for instance, a combustion cylinder 11 having a cylindrical shape, a premixing tube 20 disposed at the upstream side in the axial direction of the combustion cylinder 11, a first fuel nozzle 31, a second fuel nozzle 35, and an ignition plug 41. The combustor 10 according to some embodiments includes a casing 70 inside which the premixing tube 20 is disposed, and a casing 80 facing the outer peripheral surface of the combustion cylinder 11 via a gap.

In the following description, the direction along the axis AX of the combustion cylinder 11 will be referred to as the axial direction of the combustion cylinder 11, or as merely the axial direction. The circumferential direction of the combustion cylinder 11 will be referred to as merely the circumferential direction. The radial direction of the combustion cylinder 11 will be referred to as merely the radial direction. Furthermore, of the axial direction, the upstream side along the direction of flow of combustion gas will be referred to as the upstream side in the axial direction. Similarly, of the axial direction, the downstream side along the direction of flow of combustion gas will be referred to as the downstream side in the axial direction.

(Combustion Cylinder 11)

As described above, the combustion cylinder 11 according to some embodiments has a cylindrical shape, and has openings at both ends in the axial direction. The downstream side of the combustion cylinder 11 is connected to the turbine 5. Compressed air is capable of flowing through between the combustion cylinder 11 and the casing 80, as described below.

The combustion cylinder 11 according to some embodiments has, as depicted in FIG. 2 for instance, an end portion 11*a* at the downstream side in the axial direction retained by an inward flange 90 via a retention member 130. The combustion cylinder 11 according to some embodiments is fixed to the casing 80 at a position at the upstream side in the axial direction. The casing 80 is a tubular member including the inward flange 90, and facing the outer peripheral surface 11*c* of the combustion cylinder 11 via a gap. The combustion cylinder 11 according to some embodiments is configured to elastically retain an outer wall portion 28 via a spring portion 100. The spring portion 100 and the retention member 130 will be described later in detail.

(Premixing Tube 20)

In some embodiments, the premixing tube 20 is disposed at the upstream side in the axial direction of the combustion cylinder 11 as described above. The premixing tube 20 according to some embodiments includes, as depicted in FIG. 4 for instance, a scroll flow passage 23 extending in the circumferential direction of the combustion cylinder 11, and an axial flow passage 25 extending in the axial direction of the combustion cylinder 11 and connecting the scroll flow passage 23 and the inside of the combustion cylinder 11.

Furthermore, the premixing tube 20 according to some embodiments includes a tangential flow passage 21 connected to an end portion 23*a* at the upstream side, in the circumferential direction, of the scroll flow passage 23 and extending in the direction of tangent of the scroll at the end portion 23*a*. Herein, the direction of tangent of the scroll is the extension direction of the tangent to the line AXs passing through the center Cs of the flow passage cross section of the scroll flow passage 23 taken along the radial direction of the combustion cylinder 11. The center Cs of the flow passage cross section is the center of gravity in the flow passage cross section.

In some embodiments, as depicted in FIG. 3 for instance, the inlet end of the premixing tube 20, that is, the inlet end portion 21*a* at the upstream side of the tangential flow passage 21, is disposed in a region 70*b* opposite to a region 70*a* where an air inlet portion 71 described below is positioned across the axis AX, of the inside region of the casing 70 described below. The scroll flow passage 23 is formed such that the area of the flow passage cross section along the radial direction of the combustion cylinder 11 gradually decreases from the upstream side toward the downstream side in the circumferential direction.

In some embodiments, as depicted in FIG. 4 for instance, the axial flow passage 25 is a flow passage formed into an annular shape along the circumferential direction. The end portion 25*a* at the upstream side, in the axial direction, of the axial flow passage 25 is connected to an opening portion 23*b* having an annular opening on the wall surface at the downstream side of the scroll flow passage 23 in the axial direction. The end portion 25*b* at the downstream side of the axial flow passage 25 in the axial direction is an opening portion having an annular opening and disposed in a region at the upstream side of the combustion cylinder 11 in the axial direction.

In some embodiments, as depicted in FIG. 4 for instance, the axial flow passage 25 is a flow passage formed by a gap between an outer wall portion 28 and an inner wall portion 24. The outer wall portion 28 and the inner wall portion 24 have a tubular shape at the outer side in the radial direction that increases in diameter toward the downstream side in the axial direction. The inner wall portion 24 is disposed at the inner side of the outer wall portion 28 in the radial direction. Herein, of the outer wall portion 28 and the inner wall portion 24, only the outer wall portion 28 may have a shape that increases in diameter toward the downstream side in the axial direction. The end portion at the downstream side of the outer wall portion 28 is positioned to have a gap from the inner peripheral surface 11*d* of the combustion cylinder 11 in the radial direction.

In some embodiments, as depicted in FIG. 4 for instance, the premixing tube 20 has an inner wall portion 24 extending in the axial direction in a region at the inner side of the scroll flow passage 23 in the radial direction. The inner wall portion 24 is connected to a wall surface forming the scroll flow passage 23. In some embodiments, the inner region of the inner wall portion 24 is also referred to as a center region 24*a*. In some embodiments, an ignition plug 41, a cooling air passage 43, and the second fuel nozzle 35 are disposed in the center region 24*a*.

(Ignition Plug 41, Cooling Air Passage 43, and the Second Fuel Nozzle 35)

In some embodiments, as depicted in FIG. 4 for instance, the ignition plug 41 is an ignition plug disposed in the center region 24*a*, for igniting an air-fuel mixture of fuel and air supplied into the combustion cylinder 11 from the premixing tube 20. In some embodiments, the ignition plug 41 is disposed, in the center region 24*a*, on an end portion at the downstream side of the inner wall portion 24 in the axial direction. The cooling air passage 43 is an air passage disposed at the side of the ignition plug 41 in the center region 24*a*, and cooling air for cooling the ignition plug 41 flows through the cooling air passage 43.

In some embodiments, the second fuel nozzle 35 for supplying fuel to the inside of the combustion cylinder 11 may be provided in the center region 24*a*. By supplying fuel to the inside of the combustion cylinder 11 from the second fuel nozzle 35 upon ignition with the ignition plug 41, it is possible to increase the concentration of fuel in the vicinity of the ignition plug 41, thereby improving the ignition performance. Furthermore, as depicted in FIGS. 2 and 4 for instance, a fuel supply pipe 37 for supplying fuel to the second fuel nozzle 35 is connected to the second fuel nozzle 35.

(Guide Member 51)

In some embodiments, as depicted in FIG. 4 for instance, a guide member 51 for rectifying the flow of air flowing into the scroll flow passage 23 is provided at the upstream side of the scroll flow passage 23 in the circumferential direction. The guide member is disposed in the vicinity of an inlet end portion 21*a* at the upstream side of the tangential flow passage 21. The guide member 51 is a short-tube-like member of a bell mouth shape having an inner peripheral surface whose radius increases toward the upstream side.

With the guide member 51, it is possible to suppress difference in the flow rate of compressed air flowing through the scroll flow passage 23 at different positions in the flow passage cross section along the radial direction of the combustion cylinder 11. Accordingly, it is possible to suppress difference in the mixing state of fuel and air in the scroll flow passage 23 at different positions of the flow passage cross section.

(First Fuel Nozzle 31)

In some embodiments, the first fuel nozzle 31 is disposed at the upstream side, in the circumferential direction, of the scroll flow passage 23. The first fuel nozzle 31 according to some embodiments has an injection hole 31*a* for injecting fuel into the scroll flow passage 23. In some embodiments, as depicted in FIGS. 2 to 4 for instance, the first fuel nozzle 31 has only a single injection hole 31*a*. The injection hole 31*a* is disposed at a position overlapping, in the axial direction, with a range where the scroll flow passage 23 exists. The configuration of the first fuel nozzle 31 is not limited to the above, and a plurality of injection holes 31*a* may be provided.

(Casing 70)

In some embodiments, as depicted in FIGS. 2 and 3 for instance, the combustor 10 includes a casing 70 for housing the premixing tube 20 inside. The casing 70 has an air inlet portion 71 through which compressed air from the compressor 3 is supplied into the casing 70, a side wall portion 73 covering the premixing tube 20 from the outer side in the radial direction of the combustion cylinder 11 and having the air inlet portion 71 formed partially thereof, and a pair of wall portions 75 covering the premixing tube 20 from the outer sides in the axial direction of the combustion cylinder 11.

As depicted in FIG. 2, an opening portion 75*a* is formed on the wall portion 75 at the downstream side, in the axial direction, of the pair of wall portions 75. In some embodiments, the inner region of the casing 70 and the inner region of the combustion cylinder 11 are in communication via the opening portion 75*a*. Furthermore, the inner region of the casing 70 and the region surrounded by the inner peripheral surface 80*a* of the casing 80 and the outer peripheral surface 11*c* of the combustion cylinder 11 are in communication via the opening portion 75*a*. In some embodiments, as depicted in FIGS. 2 and 4 for instance, the outer wall portion 28 is disposed so as to protrude from the opening portion 75*a* toward the downstream side in the axial direction.

(Overview of the Flow of Compressed Air, Air-Fuel Mixture, and Combustion Gas)

Next, the flow of compressed air, air-fuel mixture, and combustion gas in the combustor 10 according to some embodiments will be described. The compressed air supplied from the compressor 3 and heated at the heat exchanger 9 flows into the casing 70 from the air inlet portion 71, as indicated by arrow a1 in FIG. 2. The compressed air flowing into the inside of the casing 70 flows mainly between the premixing tube 20 and the pair of wall portions 75 as indicated by arrows a2, a3 in FIG. 2.

As depicted in FIG. 2, compressed air flowing between the premixing tube 20 and the wall portion 75 at the downstream side in the axial direction is divided into a flow flowing to a region surrounded by the inner peripheral surface 80*a* of the casing 80 and the outer peripheral surface 11*c* of the combustion cylinder 11 indicated by arrows a4, a7, a flow flowing into a region surrounded by the inner peripheral surface 11*d* of the combustion cylinder 11 and the outer peripheral surface of the outer wall portion 28 indicated by arrows a5, a8, and a flow flowing toward the inlet side of the premixing tube 20 indicated by arrows a6, a9, a10. Furthermore, compressed air flowing between the premixing tube 20 and the wall portion 75 at the upstream side in the axial direction flows toward the inlet side of the premixing tube 20 as indicated by arrows a2, all, a12.

As depicted in FIGS. 2 to 14, compressed air flowing toward the inlet side of the premixing tube 20 flows into the tangential flow passage 21 of the premixing tube 20 from the inlet 51*a* at the upstream side of the guide member 51 as indicated by arrows a10, a12, and flows into the tangential flow passage 21 from the annular gap between the outer peripheral surface 51*b* of the guide member 51 and the inner peripheral surface 21*b* of the tangential flow passage 21 as indicated by arrows a9, a11. The fuel injected from the injection hole 31*a* of the first fuel nozzle 31 and the compressed air flowing into the premixing tube 20 are pre-mixed inside the premixing tube 20, mainly inside the scroll flow passage 23, and become an air-fuel mixture.

The air-fuel mixture flowing through the scroll flow passage 23 flows along the inner peripheral surface of the outer wall portion 28 via the axial flow passage 25 (see FIG. 4) as indicated by arrow g1 in FIG. 2. A part of the air-fuel mixture forms a circulation flow as indicated by arrow g5, and the remainder forms a circulation flow which flows into the combustion cylinder 11 as indicated by arrow g2. The air-fuel mixture is ignited by the ignition plug 41 at an end portion at the downstream side of the inner wall portion 24 in the axial direction, becomes combustion gas and flows toward the downstream side in the axial direction of the combustion cylinder 11 as indicated by arrow g3. Then, the combustion gas is discharged from the combustion cylinder 11 and flows into the turbine 5 as indicated by arrow g4. In the region 11*r* where a circulation flow of air-fuel mixture indicated by arrow g5 is generated, the flow velocity of air-fuel mixture is relatively low, and thus it is possible to ensure a state suitable for flame holding.

(Flow of Compressed Air Between the Combustion Cylinder 11 and the Casing 80)

As described above, in some embodiments, compressed air supplied via the casing 70 is capable of flowing into the space between the outer peripheral surface 11*c* of the combustion cylinder 11 and the inner peripheral surface 80*a* of the casing 80 as indicated by arrows a4, a7 in FIG. 2. As the compressed air flows between the outer peripheral surface 11*c* of the combustion cylinder 11 and the inner peripheral surface 80*a* of the casing 80 toward the downstream side in the axial direction as indicated by arrow a13, it is possible to cool the combustion cylinder 11 with the compressed air.

In some embodiments, the combustion cylinder 11 has a plurality of opening portions 13. With the above configuration, in a case where compressed air (cooling air) flows into the space between the casing 80 and the combustion cylinder 11, it is possible to supply air into the combustion cylinder 11 via the plurality of opening portions 13 from the space as indicated by arrow a14 in FIG. 2. Accordingly, it is possible to maintain the temperature inside the combustion cylinder 11 to be higher in the region at the upstream side, in the axial direction, of the plurality of opening portions 13 than in the region at the downstream side, in the axial direction, of the plurality of opening portions 13. Thus, it is possible to stabilize the combustion state in the region at the upstream side, in the axial direction, of the plurality of opening portions 13, and suppress the temperature of combustion gas in the region at the downstream side, in the axial direction, of the plurality of opening portions 13.

(Cut-Out Portion 15 at the Downstream Side in the Axial Direction of the Combustion Cylinder 11)

In the combustor 10 according to some embodiments, as depicted in FIG. 2, the combustion cylinder 11 has a plurality of cut-out portions 15 formed so as to extend in the axial direction from the end portion 11*a* at the downstream side, in the axial direction, of the combustion cylinder 11, along the circumferential direction at intervals. Furthermore, the inward flange 90 is configured to press and retain the end portion 11*a* at the downstream side in the axial direction of the combustion cylinder 11 from the outer side in the radial direction of the combustion cylinder 11. In the combustor 10 according to some embodiments, each of divided cylindrical portions 17 at the downstream side in the axial direction of the combustion cylinder 11 divided by the cut-out portions 15 at intervals in the circumferential direction is capable of moving the end portion 11*a* in the radial direction separately from the other divided cylindrical portions 17.

Thus, when the combustion cylinder 11 is retained by the inward flange 90, the end portion 11*a* is moved inward in the radial direction against the elastic force of the divided cylindrical portion 17, and thereby the divided cylindrical portion 17 presses the inward flange 90 outward in the radial direction with the elastic force. Accordingly, it is possible to retain the end portion 11*a* at the downstream side in the axial direction of the combustion cylinder 11 with the inward flange 90. Furthermore, since it is possible to retain the combustion cylinder 11 with the inward flange 90 using the elastic force of the combustion cylinder 11 (divided cylindrical portion 17), it is possible to suppress vibration of the combustion cylinder 11 upon combustion, and improve the durability of the combustion cylinder 11.

(Spring Portion 100)

Next, with reference to FIGS. 5 to 23, the spring portion 100 according to some embodiments will be described. In the example described below, the outer wall portion 28 of the premixing tube 20 is a combustion-chamber forming member. Nevertheless, in the present disclosure, the combustion-chamber forming member is not limited to the outer wall portion 28. The combustion-chamber forming member may be a member which is disposed such that at least a part of the combustion-chamber forming member is inserted into the combustion cylinder 11, and which forms a combustion chamber inside the combustor 10 with the combustion cylinder 11.

Figure 5:
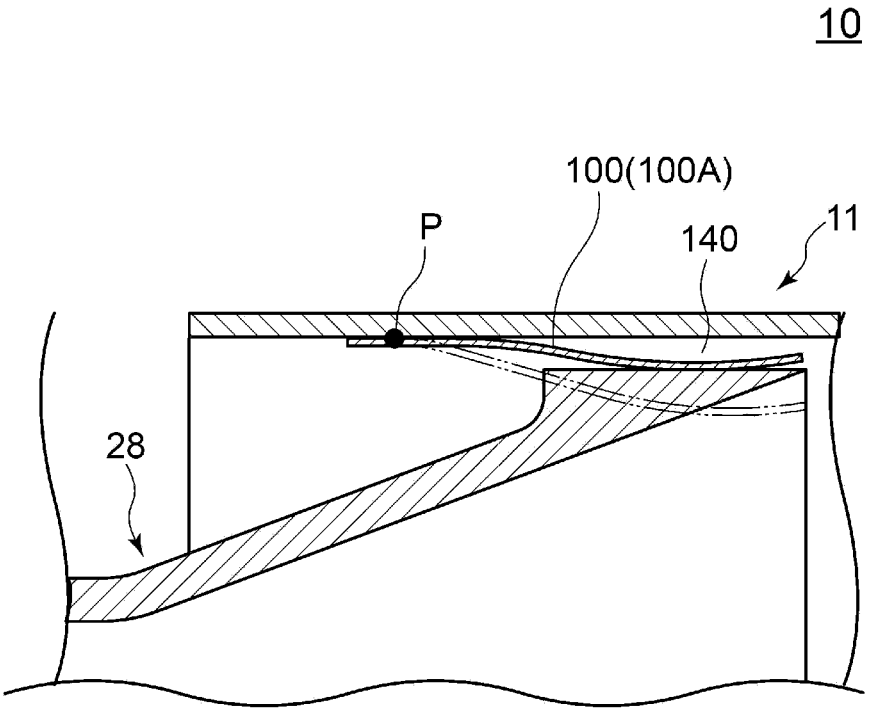
FIG. 5 is an enlarged schematic view corresponding to FIG. 2, showing the vicinity of a spring portion according to an embodiment.
Figure 6:
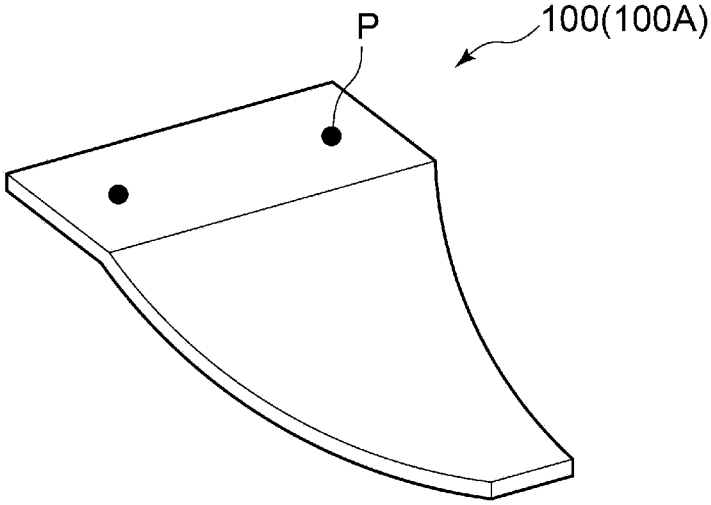
FIG. 6 is a perspective view schematically showing the spring portion depicted in FIG. 5.
Figure 7A:
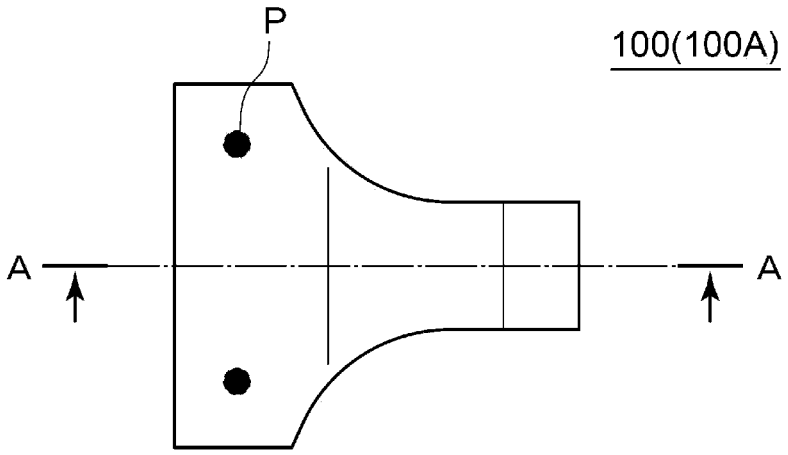
FIG. 7A is a planar view schematically showing the spring portion depicted in FIG. 5.
Figure 7B:
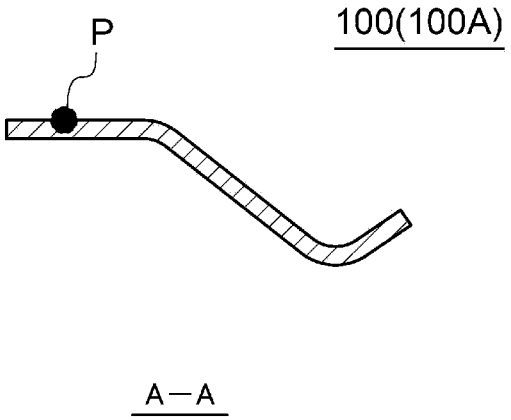
FIG. 7B is a schematic diagram showing a cross-sectional arrow view taken along line A-A in FIG. 7A.
Figure 8:
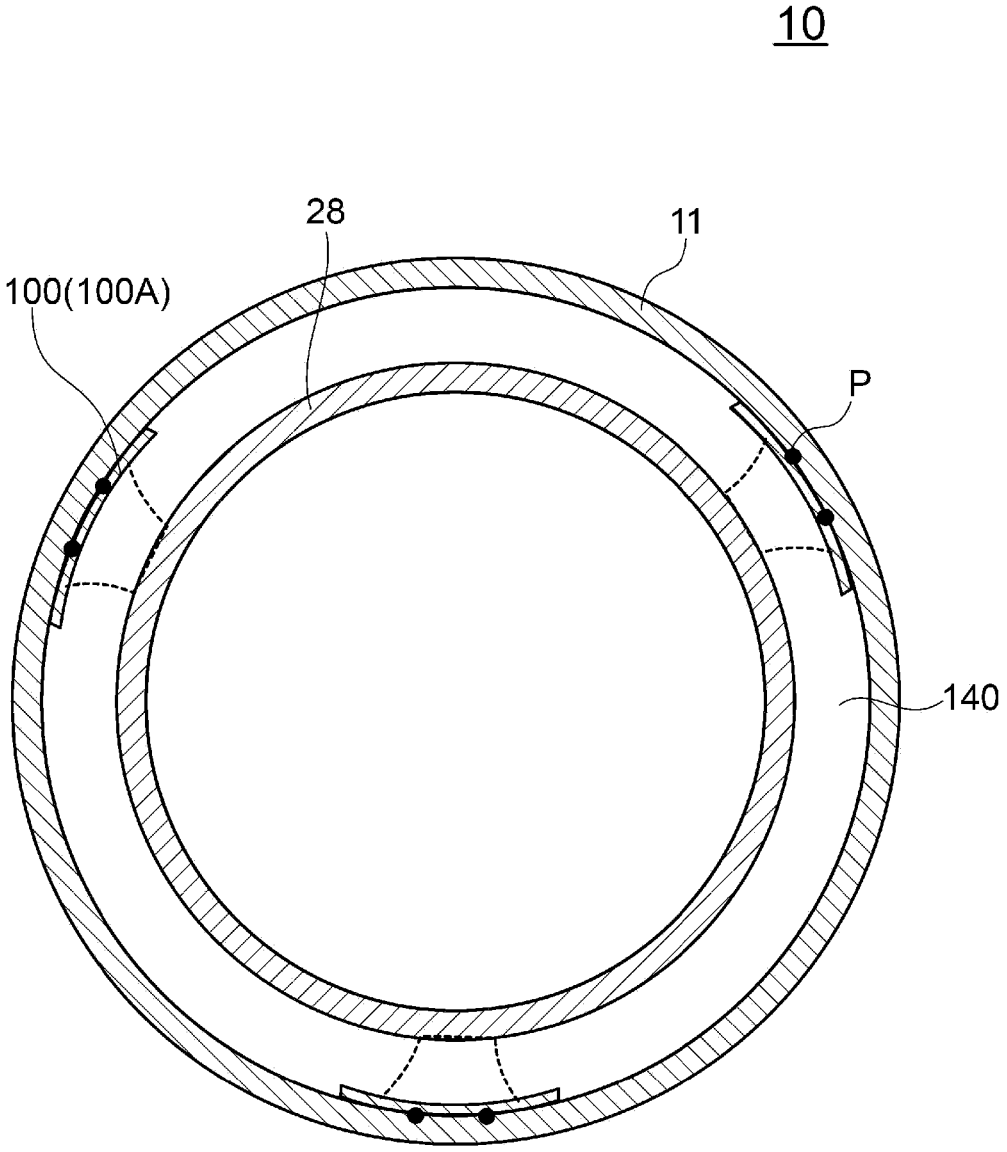
FIG. 8 is an enlarged view schematically showing the vicinity of the spring portion depicted in FIG. 5, in a cross-section taken along the radial direction.

FIG. 5 is an enlarged schematic view corresponding to FIG. 2, showing the vicinity of a spring portion 100 (100A) according to an embodiment. FIG. 6 is a perspective view schematically showing the spring portion 100 (100A) depicted in FIG. 5. FIG. 7A is a planar view schematically showing the spring portion 100 (100A) depicted in FIG. 5. FIG. 7B is a side view schematically showing a cross-sectional arrow view taken along line A-A in FIG. 7A. FIG. 8 is an enlarged view of the vicinity of the spring portion 100 (100A) depicted in FIG. 5, schematically showing a cross-section taken along the radial direction.

Figure 9:
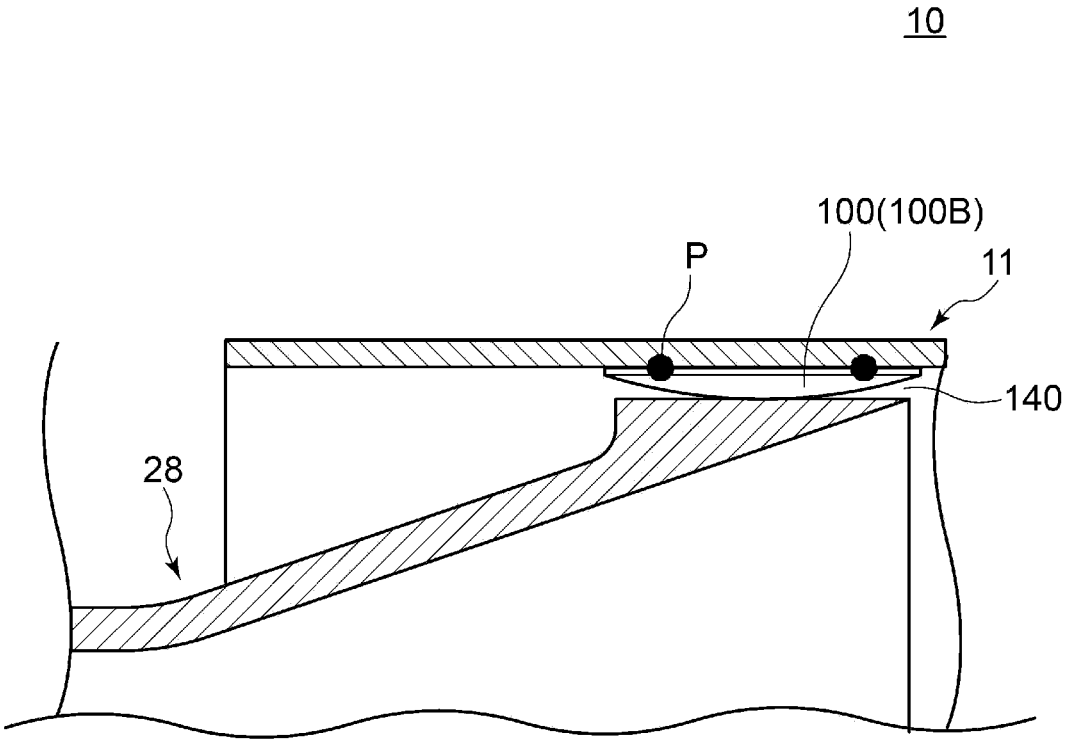
FIG. 9 is an enlarged schematic view showing the vicinity of a spring portion according to an embodiment.
Figure 10:
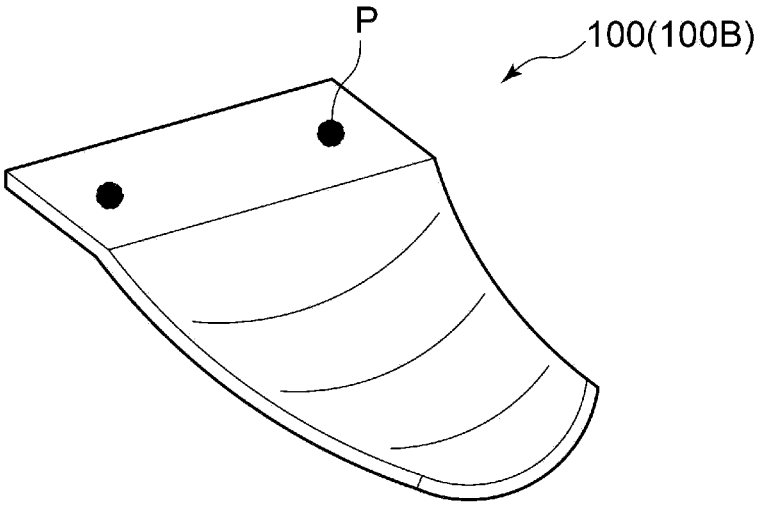
FIG. 10 is a perspective view schematically showing the spring portion depicted in FIG. 9.
Figure 11A:
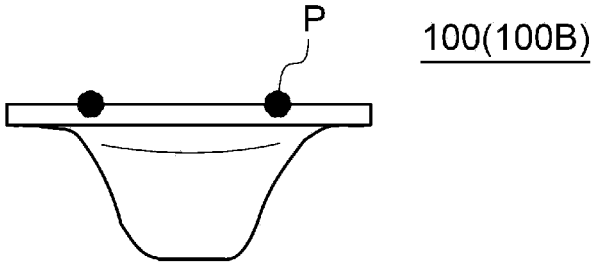
FIG. 11A is a front view schematically showing the spring portion depicted in FIG. 9.
Figure 11B:
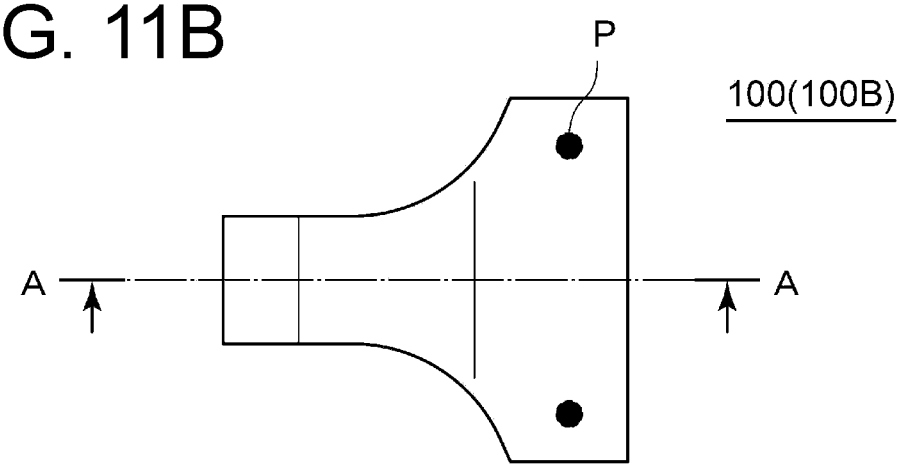
FIG. 11B is a planar view schematically showing the spring portion depicted in FIG. 9.
Figure 11C:
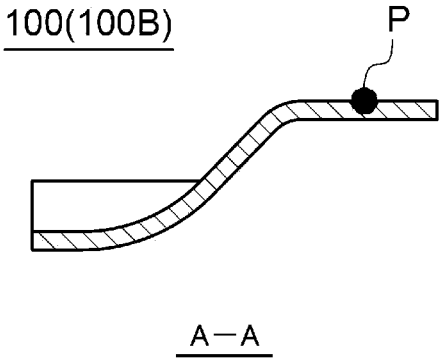
FIG. 11C is a side view schematically showing a cross-sectional arrow view taken along line A-A in FIG. 11B.
Figure 12:
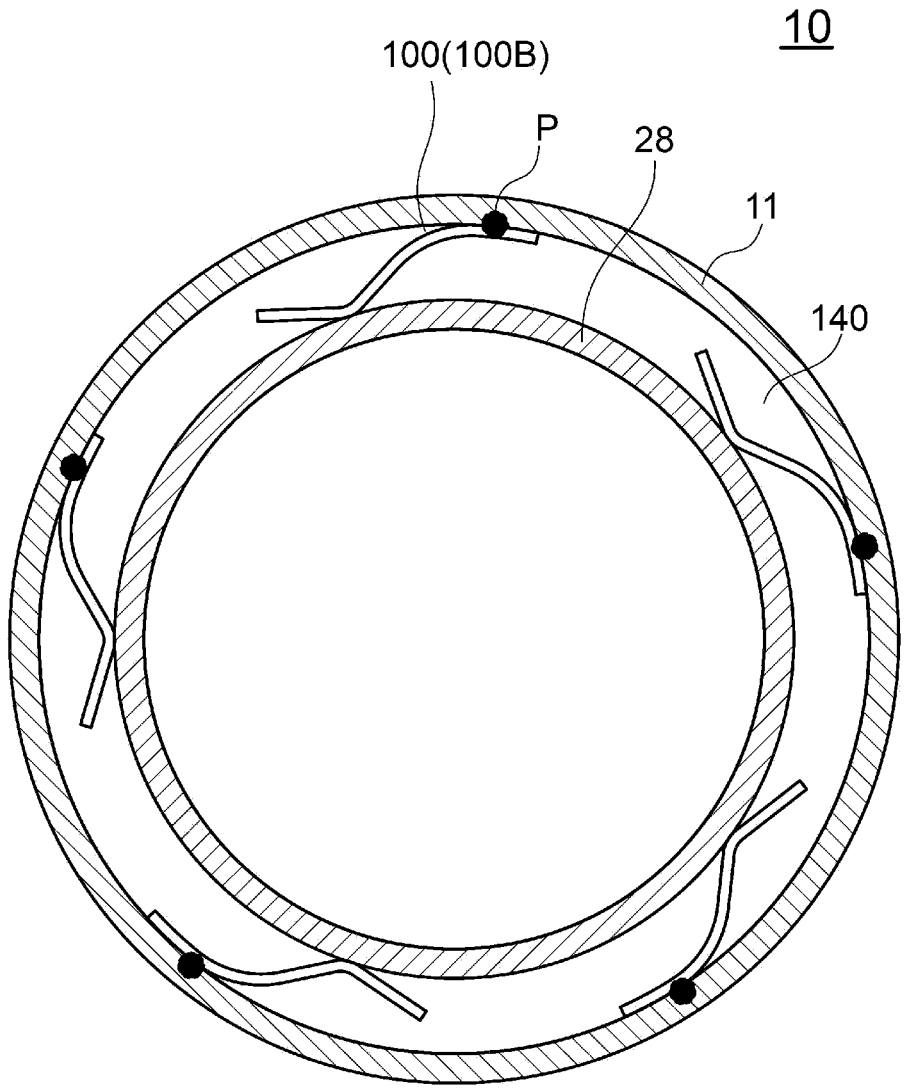
FIG. 12 is an enlarged view schematically showing the vicinity of the spring portion depicted in FIG. 9, in a cross-section taken along the radial direction.

FIG. 9 is an enlarged schematic view showing the vicinity of a spring portion 100 (100B) according to an embodiment. FIG. 10 is a perspective view schematically showing the spring portion 100 (100B) depicted in FIG. 9. FIG. 11A is a front view schematically showing the spring portion 100 (100B) depicted in FIG. 9. FIG. 11B is a planar view schematically showing the spring portion 100 (100B) depicted in FIG. 9. FIG. 11C is a side view schematically showing a cross-sectional arrow view taken along line A-A in FIG. 11B. FIG. 12 is an enlarged view of the vicinity of the spring portion 100 (100B) depicted in FIG. 9, schematically showing a cross-section taken along the radial direction.

Figure 13:
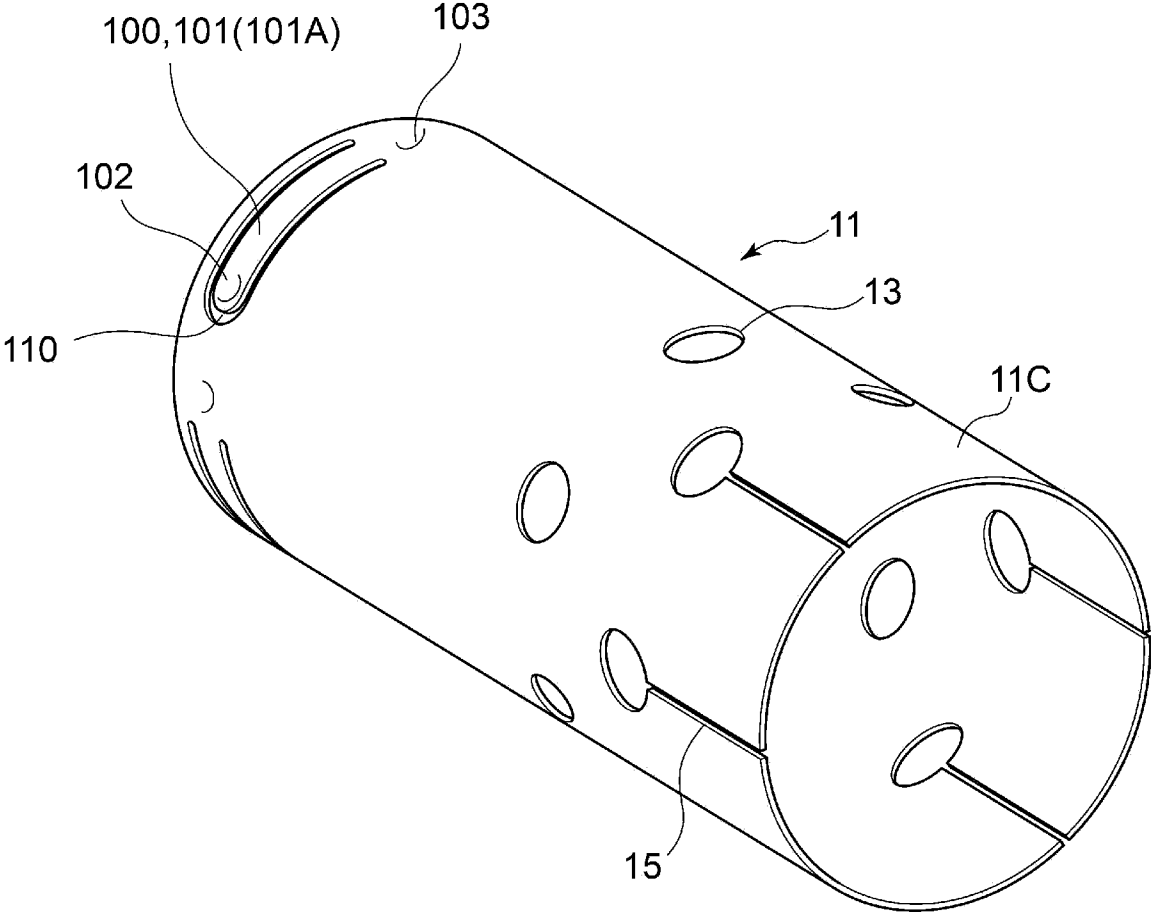
FIG. 13 is an enlarged perspective view schematically showing a combustion cylinder including a spring portion according to an embodiment.
Figure 14:
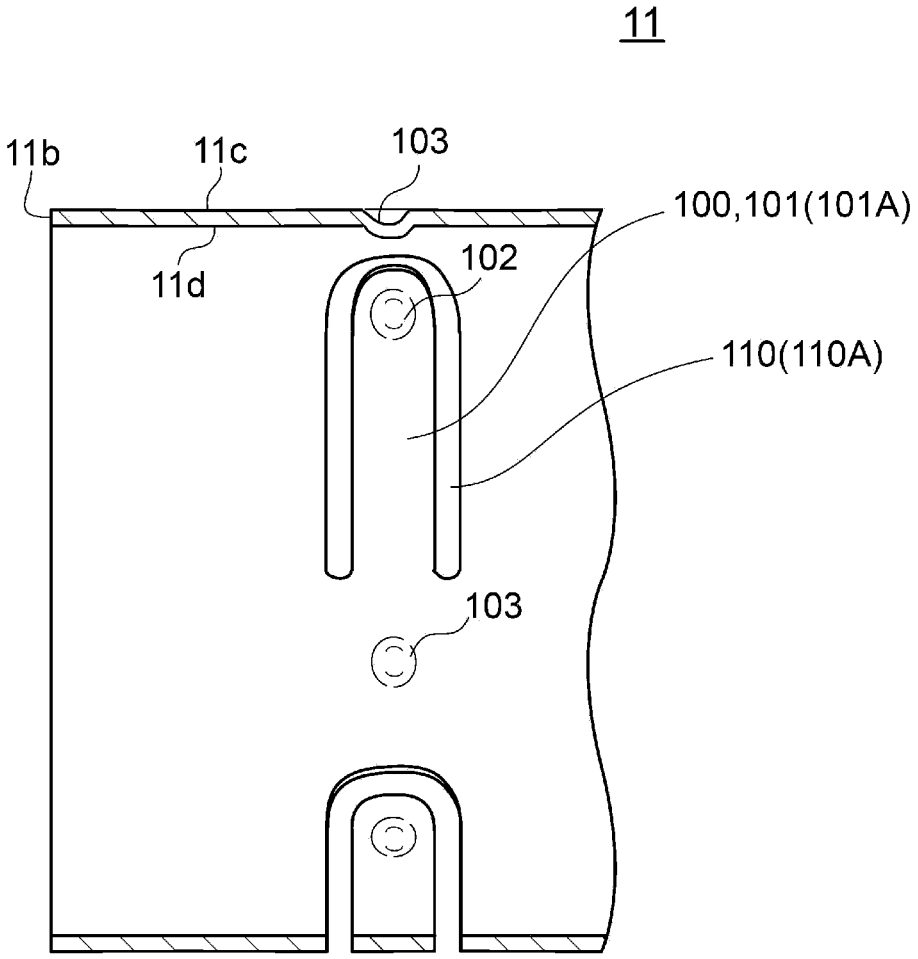
FIG. 14 is an enlarged schematic cross-sectional view showing the vicinity of the spring portion depicted in FIG. 13.
Figure 15:
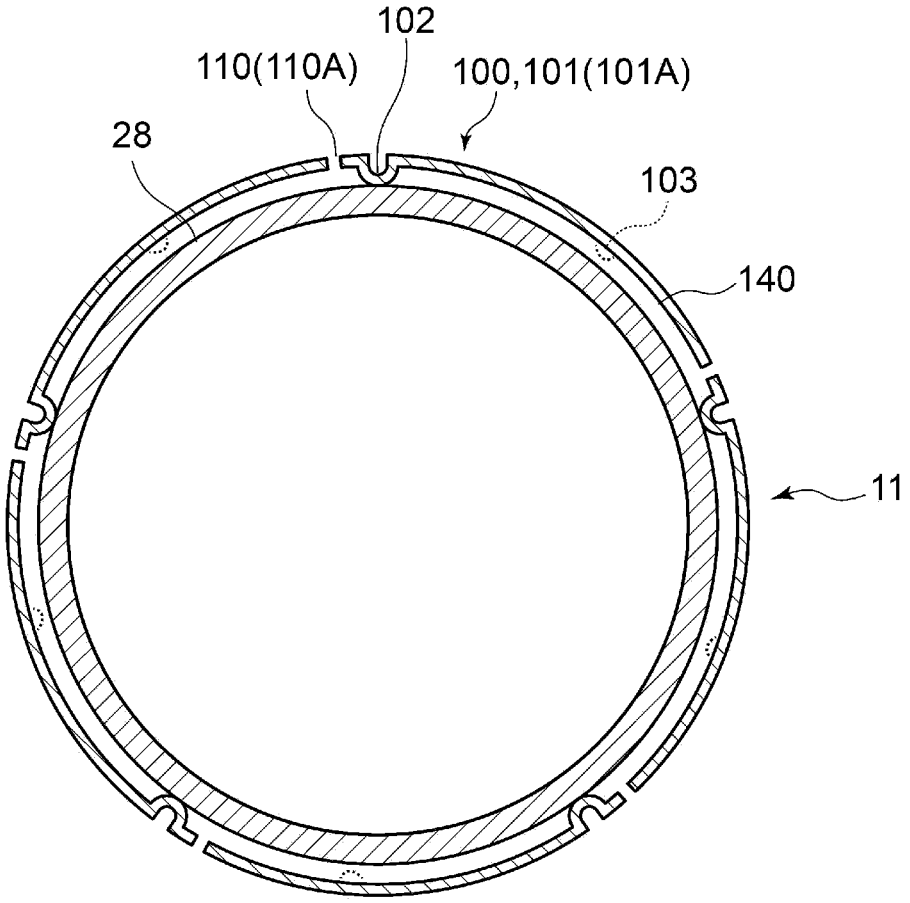
FIG. 15 is an enlarged view schematically showing the vicinity of the spring portion depicted in FIG. 13, in a cross-section taken along the radial direction.
Figure 16:
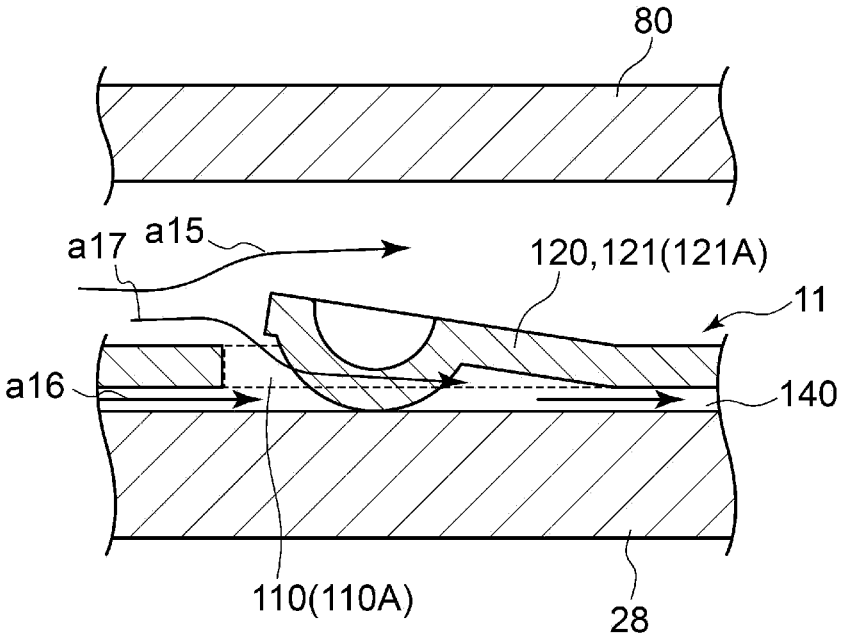
FIG. 16 is an enlarged view schematically showing the vicinity of a spring portion according to a comparative example, in a cross-section taken along the axis AX of the combustion cylinder.
Figure 17:
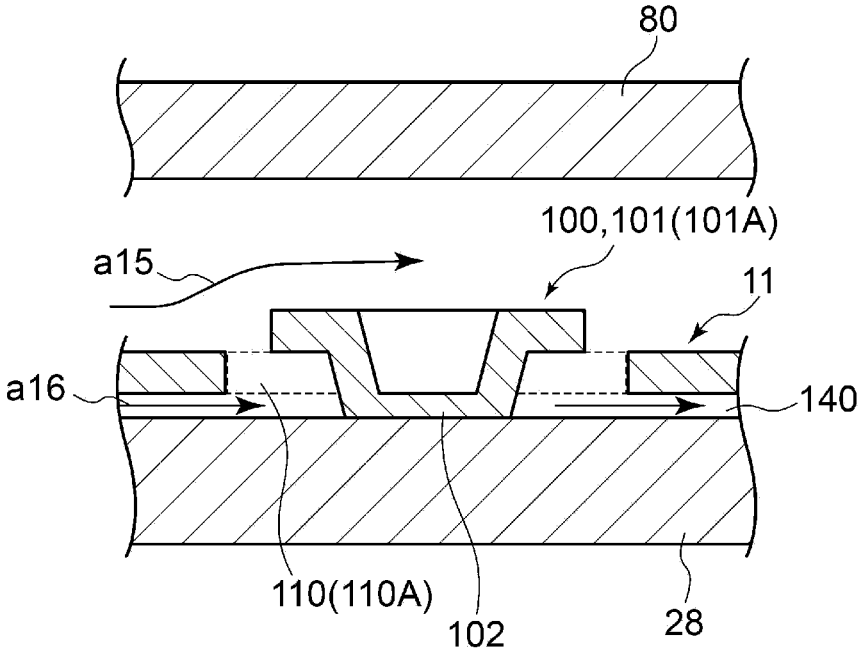
FIG. 17 is an enlarged view schematically showing the vicinity of the spring portion depicted in FIG. 13, in a cross-section taken along the axis AX of the combustion cylinder.

FIG. 13 is an enlarged schematic perspective view of a combustion cylinder 11 including a spring portion 100, 101 (101A) according to an embodiment. FIG. 14 is an enlarged schematic cross-sectional view showing the vicinity of the spring portion 100, 101 (101A) depicted in FIG. 13. FIG. 15 is an enlarged view schematically showing the vicinity of the spring portion 100, 101 (100A) depicted in FIG. 13, in a cross-section taken along the radial direction. FIG. 16 is an enlarged view schematically showing the vicinity of a spring portion 120, 121 (121A) according to a comparative example, in a cross-section taken along the axis AX of the combustion cylinder 11. FIG. 17 is an enlarged view schematically showing the vicinity of the spring portion 100, 101 (101A) depicted in FIG. 13, in a cross-section taken along the axis AX of the combustion cylinder 11.

Figure 18:
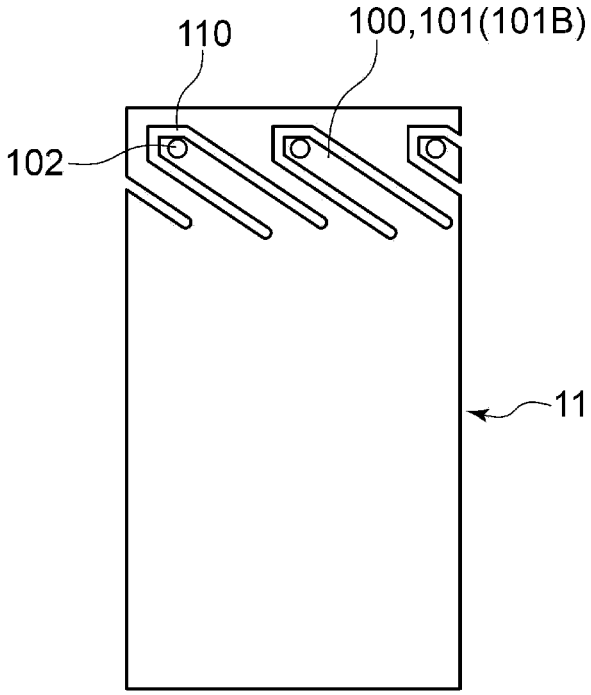
FIG. 18 is an expanded view schematically showing a part of a combustion cylinder including a spring portion according to an embodiment.
Figure 19:
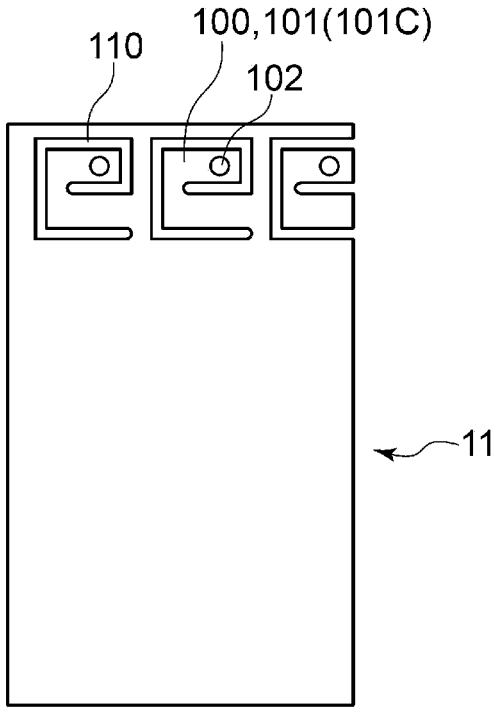
FIG. 19 is an expanded view schematically showing a part of a combustion cylinder including a spring portion according to an embodiment.

FIG. 18 is an expanded view schematically showing a part of a combustion cylinder 11 including a spring portion 100, 101 (101B) according to an embodiment. FIG. 19 is an expanded view schematically showing a part of a combustion cylinder 11 including a spring portion 100, 101 (101) according to an embodiment.

Figure 20:
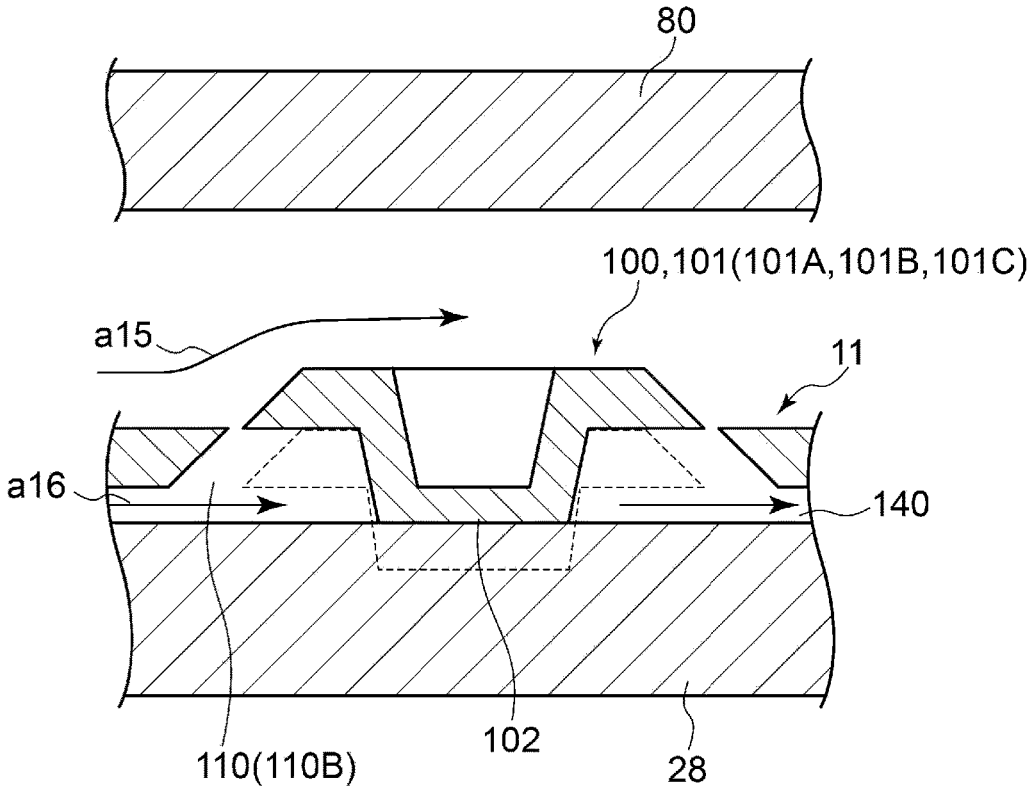
FIG. 20 is an enlarged view showing the vicinity of a spring portion according to an embodiment, in a cross-section taken along the axis AX of the combustion cylinder.
Figure 21:
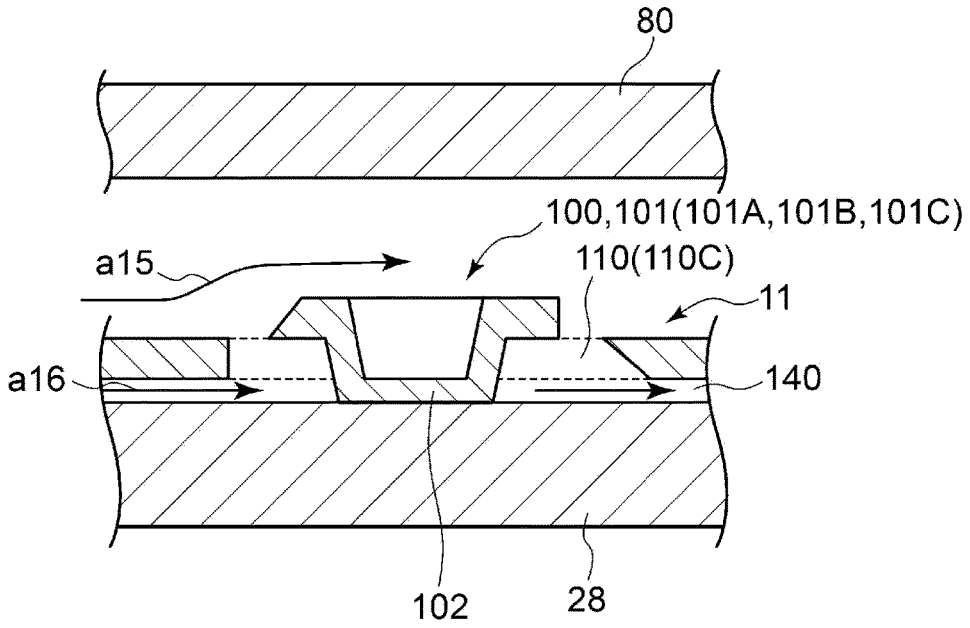
FIG. 21 is an enlarged view showing the vicinity of a spring portion according to an embodiment, in a cross-section taken along the axis AX of the combustion cylinder.

FIG. 20 is an enlarged view showing the vicinity of a spring portion 100, 101 (101A, 101B, 101C) according to an embodiment, in a cross-section taken along the axis AX of the combustion cylinder 11. FIG. 21 is an enlarged view showing the vicinity of a spring portion 100, 101 (101A, 101B, 101C) according to an embodiment, schematically showing a cross-section taken along the axis AX of the combustion cylinder.

Figure 22:
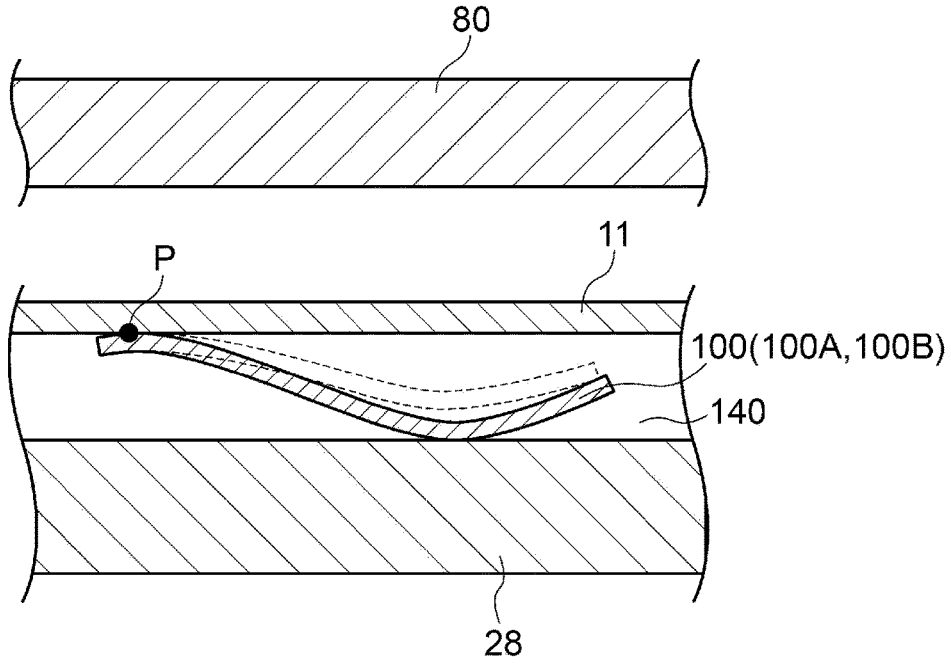
FIG. 22 is an enlarged schematic view showing the vicinity of a spring portion according to an embodiment.
Figure 23:
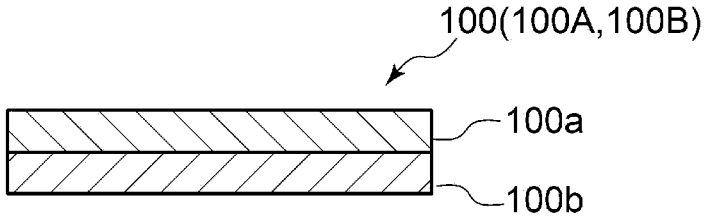
FIG. 23 is a schematic cross-sectional view showing the spring portion depicted in FIG. 22 taken along the radial direction.

FIG. 22 is an enlarged schematic view showing the vicinity of a spring portion 100, 101 (101A, 101B) according to an embodiment. FIG. 23 is a schematic view showing a cross-section taken along the radial direction of the spring portion 100, 101 (101A, 101B) depicted in FIG. 22.

In the combustor 10 according to some embodiments, as depicted in FIGS. 5, 8, 9, 12, 15, and 17 to 22, a radial-direction gap 140 for taking in film air is formed between the combustion cylinder 11 and the combustion-chamber forming member (outer wall portion 28). The film air is air flowing in a film shape along the radial-direction gap 140 at the downstream side of the flow of compressed air indicated by arrows a5, a8 in FIG. 2. It is possible to cool the inner surface of the combustion cylinder 11 with such film air.

The combustor 10 according to some embodiments includes, as depicted in FIGS. 5, 8, 9, 12, 13, 15, and 17 to 22 for instance, at least one spring portion 100 for elastically supporting the combustion-chamber forming member (outer wall portion 28) so as to be capable of being displaced in the radial direction with respect to the combustion cylinder 11 within the range of the radial-direction gap 140. The at least one spring portion 100 may include a plurality of spring portions 100 as depicted in FIGS. 8, 12, 15, 18, and 19, for instance. In this case, the combustion-chamber forming member is retained by a plurality of spring portions 100, and thereby it is possible to retain the combustion-chamber forming member (outer wall portion 28) stably with respect to the combustion cylinder 11.

The at least one spring portion 100 may be a single spring portion. However, in this case, it is necessary to provide a contact portion separately from the spring portion 100 at another position, and support the combustion-chamber forming member (outer wall portion 28) with respect to the combustion cylinder 11 with the spring portion 100 and the contact portion. The spring portion 100 may have a curved shape as depicted in FIGS. 5 to 12, for instance.

With the above configuration, the combustion-chamber forming member (outer wall portion 28) is elastically supported by at least one spring portion 100, and is capable of being displaced in the radial direction within the range of the radial-direction gap 140 for taking in film air. Vibration of the combustor 10 is suppressed by such elastic support, and noise of the combustor 10 is reduced by reducing shock from the combustion-chamber forming member (outer wall portion) 28 from the combustion cylinder 11 due to vibration.

The spring portion 100 may be, as depicted in FIGS. 5 to 12, 21 and 22 for instance, a spring member 100A, 100B having a first end fixed to the inner surface of the combustion cylinder 11 and a second end disposed so as to make contact with the combustion-chamber forming member (outer wall portion 28), and configured to bias the combustion-chamber forming member (outer wall portion 28) inward in the radial direction with respect to the combustion cylinder 11. In the above diagrams, plot P indicates the position to be fixed by spot welding.

The spring portion 100 may have a configuration opposite to the above. That is, the spring portion 100 may be a spring member 100A, 100B having a first end fixed to the outer surface of the combustion-chamber forming member (outer wall portion 28) and a second end disposed so as to make contact with inner surface of the combustion cylinder 11, and configured to bias the combustion-chamber forming member (outer wall portion 28) inward in the radial direction with respect to the combustion cylinder 11.

As described above, the spring portion 100 may be a spring member 100A, 100B having a first end fixed to one of the combustion cylinder 11 or the combustion-chamber forming member (outer wall portion 28) and a second end disposed so as to make contact with the other one, and configured to bias the combustion-chamber forming member (outer wall portion 28) inward in the radial direction with respect to to the combustion cylinder 11. With the above configuration, it is possible to support the combustion-chamber forming member (outer wall portion 28) with respect to the combustion cylinder 11 with a biasing force of the spring portion 100, and suppress vibration and noise.

The spring portion 100 may have, as depicted in FIG. 5 for instance, a fixed end fixed to the inner surface of the combustion cylinder 11 at a position outside the axial direction range of the radial-direction gap 140. The spring portion 100 may have a configuration opposite to the above. That is, the spring portion 100 may have a fixed end fixed to the outer surface of the combustion-chamber forming member (outer wall portion 28) at a position outside the axial direction range of the radial-direction gap 140.

With the above configuration, compared to a configuration in which the fixed end of the spring portion 100 is fixed to a position within the axial direction range of the radial-direction gap 140, it is possible to make effective use of the radial-direction gap 140 and ensure a displacement amount of the spring portion 100. In this case, it is possible to suppress vibration effectively with the spring portion 100 even in a case where the radial-direction gap 140 is limited to prevent the flow rate of film air from becoming excessive.

The spring portion 100 may include, as depicted in FIG. 5 for instance, a shape curved inward in the radial direction toward the downstream side. With the above configuration, the spring portion 100 is less likely to get caught when the combustion-chamber forming member (outer wall portion 28) is inserted into and assembled with the combustion cylinder 11 from the upstream side, and thus the assembling performance is improved.

The spring portion 100 may include, as depicted in FIGS. 6 to 8 for instance, a first section positioned outside the axial range of the radial-direction gap 140 between the inner surface of the combustion cylinder 11 and the combustion-chamber forming member (outer wall portion 28), and a second section having a narrower circumferential direction width than the first section and positioned inside the radial-direction gap 140. With the above configuration, the circumferential direction width of the spring portion 100 is reduced inside the radial-direction gap 140, and thus it is possible to reduce hindering of the flow of film air by the spring portion 100 inside the radial-direction gap.

The spring portion 100 may be disposed inside the radial-direction gap 140 as depicted in FIGS. 9 to 12 for instance, and include a fixed end and an extension portion extending in the circumferential direction from the fixed end and being capable of being displaced in the radial direction. With the above configuration, compared to a case where the spring portion 100 extends along the flow direction (axial direction) of film air, the projection area of the spring portion 100 with respect to the flow direction of the film air is reduced. In this case, the pressure loss is small, and thus it is possible to reduce hindering of the film air by the spring portion 100. Furthermore, since the pressure loss is small, it is possible to relax the limit on the number of spring portions 100 that can be provided. As a result, it is possible to provide a larger number of spring portions 100 and realize stable retention.

The spring portion 100 may have, as depicted in FIGS. 9, 10, 11A, 11B, and 11C for instance, a curved shape which extends away from the other one with a distance, in the axial direction, from the contact portion to the combustion-chamber forming member (outer wall portion 28), in a cross section taken along the axial direction of the combustion cylinder 11. Furthermore, the spring portion 100 may have a configuration opposite to the above. That is, the spring portion 100 may have a curved shape which extends away from the other one with a distance, in the axial direction, from the contact portion to the combustion cylinder 11, in a cross section taken along the axial direction of the combustion cylinder 11. With the above configuration, compared to a case where the spring portion 100 makes contact in a plane, it is possible to reduce hindering of the flow of film air by the spring portion 100.

In some embodiments, as depicted in FIGS. 13 to 15, and 17 to 21 for instance, the combustion cylinder 11 may include at least one click portion 101 (101A, 101B, 101C) formed by a slit 110 (110A, 110B), and the spring portion 100 may be the click portion 101 (101A, 101B, 101C). For instance, as depicted in FIGS. 14, 18, and 19, the tip end of the click portion 101 (101A, 101B, 101C) may have an arc shape, a V-shape or a rectangular shape.

With the above configuration, it is possible to elastically support the combustion-chamber forming member (outer wall portion 28) on the combustion cylinder 11 with the spring portion 100, and suppress vibration and noise. Furthermore, it is possible to form the spring portion 100 by processing the combustion cylinder 11 itself, and thus it is possible to suppress an increase in the number of parts. The click portion 101 is formed by, for instance, forming a slit 110 by sheet-metal processing, and then bending the tip end side of an area whose outer periphery is surrounded by the slit 110 inward in the radial direction.

The click portion 101 (101A, 101B, 101C) may be, for instance, disposed so as to intersect with the axial direction as depicted in FIGS. 13 to 15, and FIGS. 17 to 21. For instance, as depicted in FIG. 14, the spring portion 100 may be the click portion 101 (101A) having an elongated length in the circumferential direction of the combustion cylinder 11.

Furthermore, for instance, as depicted in FIG. 18, the spring portion 100 may be a click portion 101 (101B) having an elongated length in a direction intersecting with the circumferential direction and the axial direction of the combustion cylinder 11. In this case, compared to a case where the click portion 101 (101B) has an elongated shape along the circumferential direction or the axial direction of the combustion cylinder 11, the limitations in terms of design (e.g., the number, strength, rigidity of spring portions 100, etc.) are relaxed. For instance, as depicted in FIG. 19, the spring portion 100 may be a click portion 101 (101C) formed on the combustion cylinder 11 in a spiral shape. In this case, compared to a case where the click portion 101 (101C) has an elongated shape along the circumferential direction or the axial direction of the combustion cylinder 11, the limitations in terms of design (e.g., the number, strength, rigidity of spring portions 100, etc.) are relaxed.

In FIGS. 16, 17, 20, and 21, the arrow a15 indicates a flow of air flowing between the combustion cylinder 11 and the casing 80, and the arrow a16 indicates the flow of air flowing between the combustion cylinder 11 and the combustion-chamber forming member (outer wall portion 28). Herein, at the spring portion 120, 121 (121A) according to a comparative example depicted in FIG. 16, as indicated by the arrow a17, air flows from the outer side toward the inner side of the combustion cylinder 11, and thereby the inside air and the outside air of the combustion cylinder 11 (air flows indicated by arrow a15 and arrow a16) are mixed. This is because the click portion 121 (121A) is disposed along the axial direction.

In contrast, with the configuration according to the above embodiment, the click portion 101 (101A, 101B, 101C) is disposed so as to intersect with the axial direction. Thus, compared to a case where the click portion 101 (101A, 101B, 101C) is disposed along the flow direction of air (axial direction), it is possible to suppress mixing of the inside air and the outside air of the combustion cylinder 11 due to inflow of air from the outside toward the inside of the combustion cylinder 11 via the slit 110 (110A, 110B, 110C) forming the click portion 101 (101A, 101B, 101C).

For instance, as depicted in FIGS. 18 and 19, the at least one click portion 101 may include a plurality of click portions 101 (101B, 101C) being in contact with the combustion-chamber forming member (outer wall portion 28) at different circumferential-direction positions from one another. The click length of the click portion 101 (101B, 101C) may be longer than the circumferential direction pitch of the contact positions (first contact portions 102) of the click portions 101 (101B, 101C) adjacent to one another in the circumferential direction. With the above configuration, even when the circumferential direction pitch is narrowed to increase the number of click portions 101 (101B, 101C), the click length of each click portion 101 (101B, 101C) is long, and thus it is possible to ensure the margin for adjusting the spring constant.

The click portion 101 may include, as depicted in FIGS. 13 to 15, and FIGS. 17 to 21 for instance, the first contact portion 102 disposed so as to protrude inward in the radial direction of the combustion cylinder 11 and be in contact with the combustion-chamber forming member (outer wall portion 28). The first contact portion 102 may be formed by emboss processing. Furthermore, the first contact portion 102 may be disposed in a tip end region (tip end side of the intermediate position) of the click portion 101.

The slit 110 (110B, 110C) may include, as depicted in FIGS. 20 and 21 for instance, an oblique portion having an oblique shape with respect to the thickness direction of the combustion cylinder 11 in a cross section along the axial direction. The slit 110 may have the oblique portion at each end like the slit 110 (110B) depicted in FIG. 20, or may have the oblique portion at only one end like the slit 110 (110C) depicted in FIG. 21.

With the above configuration, as a result of the first contact portion 102 being pressed outward in the radial direction in a state where the combustion-chamber forming member (outer wall portion 28) is inserted, the spring portion 100 may protrude outward in the radial direction. Herein, the oblique portion of the slit 110 (110B, 110C) has an oblique shape with respect to the thickness direction of the combustion cylinder 11, and thus it is possible to reduce occurrence of hindering or mixing of the air flow due to formation of a step in the vicinity of the slit 110 (110B, 110C). Furthermore, the gap formed by the slit 110 (110B, 110C) in a state where the combustion-chamber forming member (outer wall portion 28) is inserted is small, and thus it is possible to suppress inflow of air to the inside of the combustion cylinder 11 through the slit 110 (110B, 110C).

The spring portion 100 (100A, 100B) may include, as depicted in FIG. 23 for instance, a bimetal containing at least two materials of different linear expansion coefficients. The bimetal of the spring portion 100 (100A, 100B) is configured such that the linear expansion coefficient at the outer side in the radial direction of the combustion cylinder 11 is higher than the linear expansion coefficient at the inner side in the radial direction of the combustion cylinder 11. The bimetal may be clad steel. In FIG. 23 for instance, clad steel may be SUS 304 at the radial-direction outer portion 100*a* (linear expansion coefficient is high) and SUS 310 at the radial-direction inner portion 100*b* (linear expansion coefficient is low). Besides the spring member 100A, 100B, the click portion 101 may also include a bimetal.

The temperature of the combustion cylinder 11 increases during operation and decreases after shutdown. Thus, the thermal stress on the spring portion 100 increases under a high temperature, and when the temperature decreases thereafter, the reactive force may dissipate due to creep relaxation. In this regard, with the spring portion 100 (100A, 100B) including a bimetal as described above, it is possible to apply a reactive force so that the stress is maximum at the time of assembly when the temperature is low, and cause thermal warp deformation on the spring portion 100 (100A, 100B) so as to reduce a biasing force that biases the combustion-chamber forming member (outer wall portion 28) inward in the radial direction with respect to the combustion cylinder 11 during operation when the temperature is high (see FIG. 22). In FIG. 22, the broken line shows a state after occurrence of thermal warp deformation. Nevertheless, the broken line is meant for describing reduction of the biasing force due to thermal warp deformation, and is not showing that the spring portion 100 is not in contact with the combustion-chamber forming member (outer wall portion 28). Accordingly, the stress under a high temperature is reduced, and it is possible to reduce the risk of occurrence of creep relaxation.

The combustion cylinder 11 may include, as depicted in FIGS. 13 to 15 for instance, the second contact portion 103 disposed so as to protrude inward in the radial direction of the combustion cylinder 11 at such a position that the second contact portion 103 is capable of being in contact with the combustion-chamber forming member (outer wall portion 28). The second contact portion 103 is configured to make contact with the combustion-chamber forming member (outer wall portion 28) if the combustion-chamber forming member (outer wall portion 28) thermally expands due to temperature increase in an operation state.

With the above configuration, it is possible to retain the combustion-chamber forming member (outer wall portion 28) on the combustion cylinder 11 with the second contact portion 103, and it is possible to limit the position so as to maintain the radial-direction gap 140 between the combustion cylinder 11 and the combustion-chamber forming member (outer wall portion 28). Such retention is also effective in a case where the spring portion 100 (100A, 100B) including a bimetal undergoes thermal warp deformation, or the reaction force of the spring portion 100 (100A, 100B) is inadequate (e.g., when the reactive force dissipates due to occurrence of creep relaxation).

(Retention Member 130)

Next, with reference to FIGS. 24 to 26, the retention member 130 according to some embodiments will be described in detail.

Figure 24:
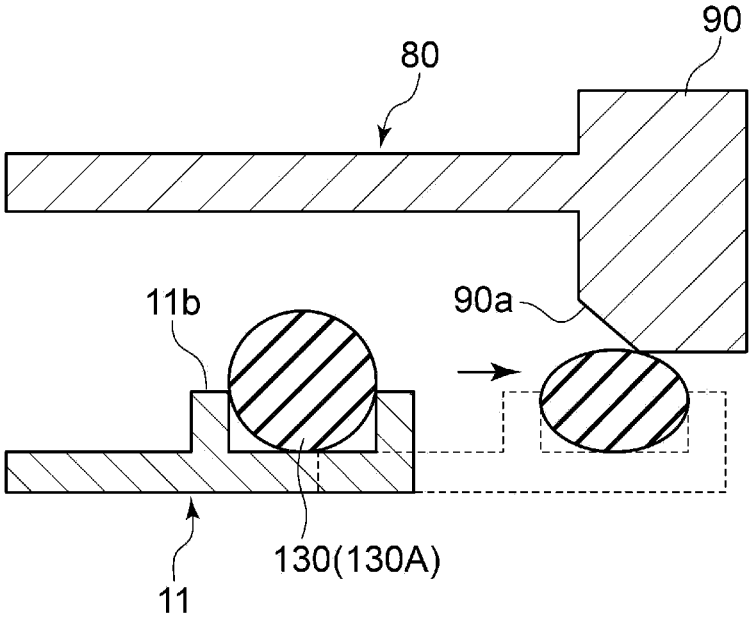
FIG. 24 is an enlarged schematic view corresponding to FIG. 2, showing the vicinity of a retention member according to an embodiment.

FIG. 24 is an enlarged schematic view corresponding to FIG. 2, showing the vicinity of a retention member 130 (130A) according to an embodiment. FIG. 25 is an enlarged schematic view corresponding to FIG. 2, showing the vicinity of a retention member 130 (130B) according to an embodiment. FIG. 26 is an enlarged schematic view corresponding to FIG. 2, showing the vicinity of a retention member 130 (130C) according to an embodiment.

The combustor 10 according to some embodiments includes a casing 80 into which a combustion cylinder 11 is inserted and which is configured to cover the outer periphery of the combustion cylinder 11, and a retention member 130 for elastically retaining the tip end of the combustion cylinder 11 on an inward flange 90 of the casing 80. With the above configuration, it is possible to elastically retain the tip end of the combustion cylinder 11 on the casing 80 in a state where the combustion cylinder 11 is inserted, and it is possible to suppress vibration and noise.

The retention member 130 may be, like the retention member 130 (130A) depicted in FIG. 24 for instance, an O-ring disposed at the tip end of the combustion cylinder 11, and configured to elastically deform when the combustion cylinder 11 is inserted into the inward flange 90 of the casing 80 as indicated by the broken line. The retention member 130 may be, like the retention member 130 (130B) depicted in FIG. 25 for instance, a C-ring disposed at the tip end of the combustion cylinder 11, and configured to elastically deform when the combustion cylinder 11 is inserted into the inward flange 90 of the casing 80 as indicated by the broken line.

The O-ring and the C-ring are configured to extend along the circumferential direction. The O-ring or the C-ring is preferably formed of a thermal resistant material or a heat insulating material in order to prevent degradation under the high-temperature environment of the combustion cylinder 11. The retention member 130 may be configured to close the gap formed on the contact portion between the inward flange 90 of the casing 80 and the combustion cylinder 11. A protruding portion 11*b* for retaining the retention member 130 (130A, 130B) may be disposed on the downstream-side end portion, that is, the tip end side, of the combustion cylinder 11.

Figure 26:
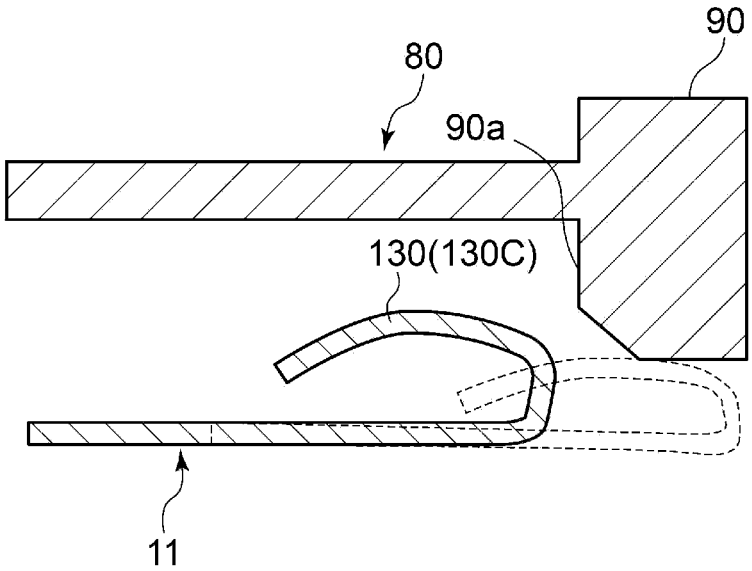
FIG. 26 is an enlarged schematic view corresponding to FIG. 2, showing the vicinity of a retention member according to an embodiment.

In some embodiments, as depicted in FIG. 26 for instance, the tip end of the combustion cylinder 11 includes a turn-back portion 130C, and the retention member 130 may be the turn-back portion 130C configured to elastically deform when the combustion cylinder 11 is inserted into the casing 80. With the above configuration, it is possible to close the gap formed at the contact portion between the casing 80 and the combustion cylinder 11 with the retention member 130 (130C).

Figure 25:
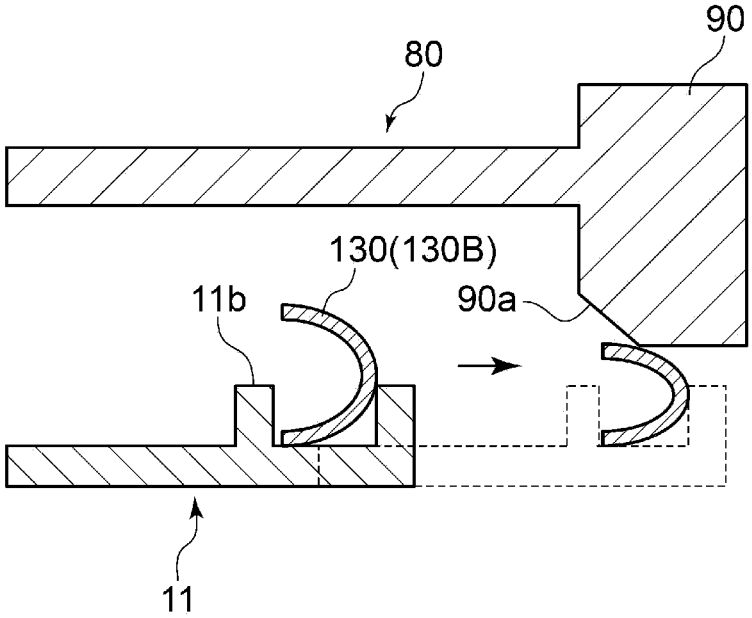
FIG. 25 is an enlarged schematic view corresponding to FIG. 2, showing the vicinity of a retention member according to an embodiment.

In some embodiments, as depicted in FIG. 24 to FIG. 26 for instance, the casing 80 may include an inward flange 90 for retaining the tip end of the combustion cylinder 11, and the inward flange 90 may have a chamfered surface 90*a* on the upstream-side end portion at the inner side in the radial direction. With the above configuration, when the combustion cylinder 11 is inserted, the retention member 130 elastically deforms in a smooth manner through contact with the chamfered surface 90*a*. Thus, the assembling performance is improved.

In some embodiments, the combustion cylinder 11 has at least one opening portion 13 formed at a position downstream of the combustion-chamber forming member (outer wall portion 28) and upstream of the retention member 130. With the above configuration, it is possible to introduce the air outside the combustion cylinder 11 into the combustion cylinder 11 via the opening portion 13.

The present disclosure is not limited to the embodiments described above, and may include an embodiment modifying one of the above embodiments or an embodiment combining the above amendments appropriately.

(Conclusion)

The contents described in the above respective embodiments can be understood as follows, for instance.

(1) A combustor (10) according to an embodiment of the present disclosure includes: a combustion cylinder (11); and a combustion-chamber forming member (e.g., outer wall portion 28) disposed so as to be at least partially inserted into the combustion cylinder and forming a combustion chamber with the combustion cylinder (11). A radial-direction gap (140) for introducing film air is formed between the combustion cylinder (11) and the combustion-chamber forming member.

To suppress NOx and CO, it is necessary to increase the temperature of the combustion region (e.g., inside the combustion chamber). However, the parts constituting the combustion region (e.g., the combustion cylinder (11)) may not have an adequate heat resistance. Thus, it is desirable to cool the parts in the region where the temperature is likely to rise (e.g., where the combustion-chamber forming member is inserted into the combustion cylinder (11)). In this regard, with the above configuration (1), it is possible to cool the inner surface of the combustion cylinder (11) with film air in the radial-direction gap (140) between the combustion cylinder (11) and the combustion-chamber forming member.

(2) In some embodiments, in the above configuration (1), the combustor (10) includes at least one spring portion (100) for elastically supporting the combustion-chamber forming member (e.g., outer wall portion 28) such that the combustion-chamber forming member is capable of being displaced in a radial direction relative to the combustion cylinder (11) within a range of the radial-direction gap (140).

With the above configuration (2), the combustion-chamber forming member (e.g., outer wall portion 28) is elastically supported by at least one spring portion 100, and is capable of being displaced in the radial direction within the range of the radial-direction gap 140 for taking in film air. Vibration of the combustor (10) is suppressed by such elastic support, and noise of the combustor (11) is reduced by reducing shock from the combustion-chamber forming member from the combustion cylinder (11) due to vibration.

(3) In some embodiments, in the above configuration (2), the at least one spring portion (100) includes a spring member (100A, 100B) having a first end fixed to one of the combustion cylinder (11) or the combustion-chamber forming member (e.g., outer wall portion 28) and a second end disposed so as to be in contact with the other one of the combustion cylinder (11) or the combustion-chamber forming member, the spring member (100A, 100B) being configured to bias the combustion-chamber forming member inward in the radial direction with respect to the combustion cylinder (11)

With the above configuration (3), it is possible to elastically retain the combustion-chamber forming member (e.g., outer wall portion 28) with respect to the combustion cylinder (11) with a biasing force of the spring portion (100), and suppress vibration and noise.

(4) In some embodiments, in the above configuration (2) or (3), the spring portion (100) has a fixed end fixed to an inner surface of the combustion cylinder (11) or an outer surface of the combustion-chamber forming member (e.g., outer wall portion 28) at a position outside an axial-direction range of the radial-direction gap (140).

With the above configuration (4), compared to a configuration in which the fixed end of the spring portion (100) is fixed to a position within the axial direction range of the radial-direction gap (140), it is possible to make effective use of the radial-direction gap (140) and ensure a displacement amount of the spring portion (100). In this case, it is possible to suppress vibration effectively with the spring portion (100) even in a case where the radial-direction gap (140) is limited to prevent the flow rate of film air from becoming excessive.

(5) In some embodiments, in any one of the above configurations (2) to (4), the spring portion (100) has a shape curved inward in the radial direction toward a downstream side.

With the above configuration (5), the spring portion (100) is less likely to get caught when the combustion-chamber forming member (e.g., outer wall portion 28) is inserted into the combustion cylinder (11) for assembly from the upstream side, and thus the assembling performance is improved.

(6) In some embodiments, in any one of the above configurations (2) to (5), the spring portion (100) includes: a first section positioned outside an axial-direction range of the radial-direction gap (140) between an inner surface of the combustion cylinder (11) and an outer surface of the combustion-chamber forming member (e.g., outer wall portion 28); and a second section having a circumferential-direction width which is narrower than that of the first section, the second section being positioned inside the radial-direction gap (140).

With the above configuration (6), the circumferential direction width of the spring portion (100) is reduced inside the radial-direction gap (140), and thus it is possible to reduce hindering of the flow of film air by the spring portion (100) inside the radial-direction gap (140).

(7) In some embodiments, in the above configuration (2) or (3), the spring portion (100) is disposed inside the radial-direction gap (140) and includes a fixed end and an extension portion which extends in a circumferential direction from the fixed end, and which is capable of being displaced in the radial direction.

With the above configuration (7), compared to a case where the spring portion (100) extends along the flow direction (axial direction) of film air, the projection area of the spring portion (100) with respect to the flow direction of the film air is reduced. In this case, pressure loss is small, and thus it is possible to reduce hindering of the film air by the spring portion (100). Furthermore, since pressure loss is small, it is possible to relax the limit on the number of spring portions (100) that can be provided. As a result, it is possible to provide a larger number of spring portions (100) and realize stable retention.

(8) In some embodiments, in any one of the above configurations (2) to (7), the spring portion (100) has, in a cross section taken along an axial direction of the combustion cylinder (11), a curved shape which extends away from the other one of the combustion cylinder (11) or the combustion-chamber forming member (e.g., outer wall portion 28) with a distance from a contact portion to the combustion cylinder or the combustion-chamber forming member in the axial direction.

With the above configuration (8), compared to a case where the spring portion (100) makes contact in a plane, it is possible to reduce hindering of the flow of film air by the spring portion (100).

(9) In some embodiments, in the above configuration (2), the combustion cylinder (11) includes at least one click portion (101) formed by a slit (110), and the spring portion (100) includes the click portion (101).

With the above configuration (9), it is possible to elastically support the combustion-chamber forming member (e.g., outer wall portion 28) with respect to the combustion cylinder 11 with the spring portion (100), and suppress vibration and noise. Furthermore, it is possible to form the spring portion (100) by processing the combustion cylinder (11) itself, and thus it is possible to suppress an increase in the number of parts.

(10) In some embodiments, in the above configuration (2) or (9), the click portion (101) is disposed so as to intersect with an axial direction.

With the above configuration (10), the click portion (101) is disposed so as to intersect with the axial direction. Thus, compared to a case where the click portion (101) is disposed along the flow direction of air (axial direction), it is possible to suppress mixing of the inside air and the outside air of the combustion cylinder 11 due to inflow of air from the outer side toward the inner side of the combustion cylinder 11 via the slit (110) forming the click portion (101).

(11) In some embodiments, in the above configuration (9) or (10), the at least one click portion (101) includes a plurality of click portions which make contact with the combustion-chamber forming member (e.g., outer wall portion 28) at different circumferential-direction positions from one another, and the click portions (101) have a click length longer than a circumferential-direction pitch of contact positions of the click portions (101) adjacent to one another in a circumferential direction.

With the above configuration (11), even when the circumferential direction pitch is narrowed to increase the number of click portions (101), the click length of each click portion (101) is long, and thus it is possible to ensure the margin for adjusting the spring constant.

(12) In some embodiments, in any one of the above configurations (9) to (11), the click portion (101) includes a first contact portion (102) disposed so as to protrude inward in the radial direction of the combustion cylinder (11) and to be in contact with the combustion-chamber forming member (e.g., outer wall portion 28), and the slit (110) includes an oblique portion having, in a cross section taken along an axial direction, an oblique shape with respect to a thickness direction of the combustion cylinder (11).

With the above configuration (12), as a result of the first contact portion (102) being pressed outward in the radial direction in state where the combustion-chamber forming member (e.g., outer wall portion 28) is inserted, the spring portion (100) may protrude outward in the radial direction. Herein, the oblique portion of the slit (110) has an oblique shape with respect to the thickness direction of the combustion cylinder (11), and thus it is possible to reduce occurrence of hindering or mixing of the air flow due to formation of a step in the vicinity of the slit (110). Furthermore, the gap formed by the slit (110) in a state where the combustion-chamber forming member is inserted is small, and thus it is possible to suppress inflow of air into the inside of the combustion cylinder (11) through the slit (110).

(13) In some embodiments, in any one of the above configurations (2) to (12), the spring portion (100) includes a bimetal including at least two materials having different linear expansion coefficients. The bimetal has a greater linear expansion coefficient at an outer side in the radial direction of the combustion cylinder (11) than at an inner side in the radial direction of the combustion cylinder (11).

The temperature of the combustion cylinder (11) increases during operation and decreases after shutdown. Thus, the thermal stress of the spring portion (100) increases under a high temperature, and if the temperature decreases thereafter, the reactive force may dissipate due to creep relaxation. In this regard, with the above configuration (13), it is possible to apply a reactive force so that the stress is maximum at the time of assembly when the temperature is low, and cause thermal warp deformation on the spring portion (100) so as to reduce a biasing force that biases the combustion-chamber forming member (e.g. outer wall portion 28) inward in the radial direction with respect to the combustion cylinder (11) during operation when the temperature is high. Accordingly, the stress under a high temperature is reduced, and it is possible to reduce the risk of occurrence of creep relaxation.

(14) In some embodiments, in any one of the above configurations (2) to (13), the combustion cylinder (11) includes a second contact portion (103) protruding inward in the radial direction of the combustion cylinder (11) and disposed at a position where the second contact portion (103) is capable of making contact with the combustion-chamber forming member (e.g., outer wall portion 28), and the second contact portion (103) is configured to make contact with the combustion-chamber forming member when the combustion-chamber forming member thermally expands due to a temperature increase in an operation state.

With the above configuration (14), it is possible to retain the combustion-chamber forming member (e.g., outer wall portion 28) on the combustion cylinder (11) with the second contact portion (103), and it is possible to limit the position so as to maintain the radial-direction gap (140) between the combustion cylinder (11) and the combustion-chamber forming member. Such retention is also effective in a case where the spring portion (100) including a bimetal undergoes thermal warp deformation, or the reaction force of the spring portion (100) is inadequate (e.g., when the reaction force dissipates due to occurrence of creep relaxation).

(15) In some embodiments, in any one of the above configurations (1) to (14), the combustor (10) includes: a casing (80) into which the combustion cylinder (11) is inserted, the casing being configured so as to cover an outer periphery of the combustion cylinder (11); and a retention member (130) for elastically retaining a tip end of the combustion cylinder (11) on the casing (80).

With the above configuration (15), it is possible to elastically retain the tip end of the combustion cylinder (11) on the casing (80) in a state where the combustion cylinder (11) is inserted, and it is possible to suppress vibration and noise.

(16) In some embodiments, in the above configuration (15), the tip end of the combustion cylinder (11) includes a turn-back portion (130C), and the retention member (130) includes the turn-back portion (130C) configured to elastically deform when the combustion cylinder (11) is inserted into the casing (90).

With the above configuration (16), it is possible to close the gap formed at the contact portion between the casing (80) and the combustion cylinder (11) with the retention member (130).

(17) In some embodiments, in the above configuration (15) or (16), the casing (80) includes an inward flange (90) for retaining the tip end of the combustion cylinder (11), and the inward flange (90) has a chamfered surface (90*a*) at an upstream-side end portion at an inner side in the radial direction.

With the above configuration (17), when the combustion cylinder (11) is inserted, the retention member (130) elastically deforms in a smooth manner through contact with the chamfered surface 90*a*. Thus, the assembling performance is improved.

(18) In some embodiments, in any one of the above configurations (1) to (17), the combustion cylinder (11) has at least one opening portion (13) formed at a position downstream of the combustion-chamber forming member (e.g., outer wall portion 28).

With the above configuration (18), it is possible to introduce the air outside the combustion cylinder (11) into the combustion cylinder (11) via the opening portion (13).

(19) According to an embodiment of the present disclosure, a combustor (10) includes: a combustion cylinder (11); a combustion-chamber forming member (e.g., outer wall portion 28) disposed so as to be at least partially inserted into the combustion cylinder (11) and forming a combustion chamber with the combustion cylinder (11); a casing (80) into which the combustion cylinder (11) is inserted, the casing being configured so as to cover an outer periphery of the combustion cylinder (11); and a retention member (130) for elastically retaining a tip end of the combustion cylinder (11) on the casing (80). The casing (80) includes an inward flange (90) for retaining the tip end of the combustion cylinder (11), and the inward flange (90) has a chamfered surface (90*a*) at an upstream-side end portion at an inner side in the radial direction (140).

With the above configuration (19), it is possible to elastically retain the tip end of the combustion cylinder (11) on the casing (80) in a state where the combustion cylinder (11)

is inserted, and it is possible to suppress vibration and noise. Furthermore, when the combustion cylinder (11) is inserted, the retention member (130) elastically deforms in a smooth manner through contact with the chamfered surface (90*a*). Thus, the assembling performance is improved.

(20) A gas turbine according to an embodiment of the present disclosure includes: the combustor (10) according to any one of the above (1) to (19); a compressor (3) for generating compressed air; and a turbine (5) configured to be rotary driven by combustion gas from the combustor (10).

With the above configuration (20), it is possible to provide a gas turbine (2) suitable for automobiles.

REFERENCE SIGNS LIST

1 Power generation apparatus
2 Gas turbine
3 Compressor
5 Turbine
7 Generator
8A, 8B Rotational shaft
9 Heat exchanger
10 Combustor
11 Combustion cylinder
11*a*, 23*a*, 25*a*, 25*b* End portion
11*b* Protruding portion
11*c*, 51*b* Outer peripheral surface
11*d*, 21*b*, 801*a* Inner peripheral surface
11*r*, 70*a*, 70*b* Region
13, 23*b*, 75*a* Opening portion
15 Cut-out portion
20 Premixing tube
21 Tangential flow passage
21*a* Inlet end portion
23 Scroll flow passage
24 Inner wall portion
24*a* Center region
25 Axial flow passage
28 Outer wall portion (combustion-chamber forming member)
31 First fuel nozzle
31*a* Injection hole
35 Second fuel nozzle
37 Fuel supply pipe
41 Ignition plug
43 Cooling air passage
47 Cooling air pipe
51 Guide member
51*a* Inlet
70, 80 Casing
71 Air inlet portion
73 Side wall portion
75 Wall portion
90 Inward flange
90*a* Chamfered surface
100, 120 Spring portion
100*a* Radial-direction outer portion
100*b* Radial-direction inner portion
101, 121 Click portion
102 First contact portion
103 Second contact portion
110 Slit
120 Spring portion
130 Retention member
140 Radial-direction gap

The invention claimed is:

1. A combustor comprising:
a combustion cylinder;
a combustion-chamber forming member disposed so as to be at least partially inserted into the combustion cylinder and forming a combustion chamber with the combustion cylinder, and
a premixing tube disposed at the upstream side in the axial direction of the combustion cylinder,
wherein a radial-direction gap for introducing film air is formed between the combustion cylinder and the combustion-chamber forming member,
wherein the premixing tube includes:
a scroll flow passage extending in the circumferential direction of the combustion cylinder, and
an axial flow passage extending in the axial direction and connecting the scroll flow passage and the inside of the combustion cylinder,
wherein the combustor is configured so that air induced from a first space to a second space is induced to the combustion cylinder through the radial-direction gap as the film air, the first space being disposed between the scroll flow passage and the combustion cylinder in the axial direction and being disposed outside of the axial flow passage in a radial direction of the combustion cylinder, the second space being disposed between an outer circumference of the combustion-chamber forming member and an inner circumference of the combustion cylinder.

2. The combustor according to claim 1, comprising:
a casing into which the combustion cylinder is inserted, the casing being configured so as to cover an outer periphery of the combustion cylinder; and
a retention member for clastically retaining a tip end of the combustion cylinder on the casing.

3. The combustion cylinder according to claim 2,
wherein the tip end of the combustion cylinder includes a turn-back portion, and
wherein the retention member comprises the turn-back portion configured to elastically deform when the combustion cylinder is inserted into the casing.

4. The combustion cylinder according to claim 2,
wherein the casing includes an inward flange for retaining the tip end of the combustion cylinder, and
wherein the inward flange has a chamfered surface at an upstream-side end portion at an inner side in the radial direction.

5. The combustor according to claim 1,
wherein the combustion cylinder has at least one opening portion formed at a position downstream of the combustion-chamber forming member.

6. A gas turbine, comprising:
the combustor according to claim 1;
a compressor for generating compressed air; and
a turbine configured to be rotary driven by combustion gas from the combustor.

7. A combustor comprising:
a combustion cylinder; and
a combustion-chamber forming member disposed so as to be at least partially inserted into the combustion cylinder and forming a combustion chamber with the combustion cylinder,
wherein a radial-direction gap for introducing film air is formed between the combustion cylinder and the combustion-chamber forming member,
wherein the combust or further comprises at least one spring portion for elastically supporting the combustion-chamber forming member such that the combustion-chamber forming member is capable of being displaced in a radial direction relative to the combustion cylinder within a range of the radial-direction gap, and wherein the spring portion includes:

a first section positioned outside an axial-direction range of the radial-direction gap between an inner surface of the combustion cylinder and an outer surface of the combustion-chamber forming member; and a second section having a circumferential-direction width which is narrower than that of the first section, the second section being positioned inside the radial-direction gap.

8. The combustor according to claim 7, wherein the at least one spring portion comprises a spring member having a first end fixed to one of the combustion cylinder or the combustion-chamber forming member and a second end disposed so as to be in contact with the other one of the combustion cylinder or the combustion-chamber forming member, the spring member being configured to bias the combustion-chamber forming member inward in the radial direction with respect to the combustion cylinder.

9. The combustor according to claim 7, wherein the spring portion has a fixed end fixed to an inner surface of the combustion cylinder or an outer surface of the combustion-chamber forming member at a position outside an axial-direction range of the radial-direction gap.

10. The combustor according to claim 7, wherein the spring portion has a shape curved inward in the radial direction toward a downstream side.

11. The combustor according to claim 7, wherein the spring portion is disposed inside the radial-direction gap and includes a fixed end and an extension portion which extends in a circumferential direction from the fixed end, and which is capable of being displaced in the radial direction.

12. The combustor according to claim 7, wherein the spring portion has, in a cross section taken along an axial direction of the combustion cylinder, a curved shape which extends away from the other one of the combustion cylinder or the combustion-chamber forming member with a distance from a contact portion to the combustion cylinder or the combustion-chamber forming member in the axial direction.

13. The combustor according to claim 7, wherein the spring portion includes a bimetal comprising at least two materials having different linear expansion coefficients, and wherein the bimetal has a greater linear expansion coefficient at an outer side in the radial direction of the combustion cylinder than at an inner side in the radial direction of the combustion cylinder.

14. The combustor according to claim 7, wherein the combustion cylinder includes a second contact portion protruding inward in the radial direction of the combustion cylinder and disposed at a position where the second contact portion is capable of making contact with the combustion-chamber forming member, and wherein the second contact portion is configured to make contact with the combustion-chamber forming member when the combustion-chamber forming member thermally expands due to a temperature increase in an operation state.

15. A combustor comprising:

a combustion cylinder; and a combustion-chamber forming member disposed so as to be at least partially inserted into the combustion cylinder and forming a combustion chamber with the combustion cylinder, wherein a radial-direction gap for introducing film air is formed between the combustion cylinder and the combustion-chamber forming member, wherein the combustor further comprises at least one spring portion for elastically supporting the combustion-chamber forming member such that the combustion-chamber forming member is capable of being displaced in a radial direction relative to the combustion cylinder within a range of the radial-direction gap, wherein the combustion cylinder includes at least one click portion formed by a slit, and wherein the spring portion comprises the click portion.

16. The combustor according to claim 15, wherein the click portion is disposed so as to intersect with an axial direction.

17. The combustor according to claim 15, wherein the at least one click portion comprises a plurality of click portions which make contact with the combustion-chamber forming member at different circumferential-direction positions from one another, and wherein the click portions have a click length longer than a circumferential-direction pitch of contact positions of the click portions adjacent to one another in a circumferential direction.

18. The combustor according to claim 15, wherein the click portion includes a first contact portion disposed so as to protrude inward in the radial direction of the combustion cylinder and to be in contact with the combustion-chamber forming member, and wherein the slit includes an oblique portion having, in a cross section taken along an axial direction, an oblique shape with respect to a thickness direction of the combustion cylinder.

19. A combustor comprising:

a combustion cylinder including a tip end which is downstream end in the axial direction;

a combustion-chamber forming member disposed so as to be at least partially inserted into the combustion cylinder and forming a combustion chamber with the combustion cylinder;

a casing into which the combustion cylinder is inserted, the casing being configured so as to cover an outer periphery of the combustion cylinder; and a retention member for elastically retaining the tip end of the combustion cylinder on the casing, wherein the casing includes an inward flange for retaining the tip end of the combustion cylinder, and wherein the inward flange has a chamfered surface facing an inner side in the radial direction and an upstream side of the axial direction.

20. The combustor according to claim 19, wherein an axial direction range of the chamfered surface includes a range overlapping with an axial direction range of the retention member.

21. The combustor according to claim 19, wherein a combustion cylinder further includes:

an outer peripheral surface, a pair of protruding portions disposed on the outer peripheral surface, the pair of protruding portions being spaced apart from each other in the axial direction, wherein the retention member is an O-ring or C-ring sandwiched between the pair of protruding portions and disposed on the outer peripheral surface.

* * * * *